US012637625B2

(12) United States Patent
Marques et al.

(10) Patent No.: US 12,637,625 B2
(45) Date of Patent: May 26, 2026

(54) HYDROCONVERSION OF A HYDROCARBON-BASED HEAVY FEEDSTOCK IN A HYBRID EBULLATED-ENTRAINED BED, COMPRISING MIXING SAID FEEDSTOCK WITH A CATALYST PRECURSOR CONTAINING AN ORGANIC ADDITIVE

(71) Applicant: IFP ENERGIES NOUVELLES, Rueil-Malmaison (FR)

(72) Inventors: Joao Marques, Rueil-Malmaison Cedex (FR); Thibaut Corre, Rueil-Malmaison Cedex (FR); Jeremie Barbier, Rueil-Malmaison Cedex (FR); Brett Matthew Silverman, Lawrenceville, NJ (US); David M. Mountainland, Lawrenceville, NJ (US); Sukesh Parasher, Lawrenceville, NJ (US)

(73) Assignee: IFP Energies Nouvelles, Rueil-Malmaison (FR)

( * ) Notice: Subject to any disclaimer, the term of this patent is extended or adjusted under 35 U.S.C. 154(b) by 185 days.

(21) Appl. No.: 18/576,621

(22) PCT Filed: Jun. 27, 2022

(86) PCT No.: PCT/EP2022/067625
§ 371 (c)(1),
(2) Date: Jan. 4, 2024

(87) PCT Pub. No.: WO2023/280626
PCT Pub. Date: Jan. 12, 2023

(65) Prior Publication Data

US 2024/0327728 A1 Oct. 3, 2024

(30) Foreign Application Priority Data

Jul. 8, 2021 (FR) ..... 2107377

(51) Int. Cl.
*C10G 47/26* (2006.01)
*C10G 47/12* (2006.01)
*C10G 67/02* (2006.01)

(52) U.S. Cl.
CPC ..... *C10G 47/26* (2013.01); *C10G 47/12* (2013.01); *C10G 67/02* (2013.01);
(Continued)

(58) Field of Classification Search
CPC ..... C10G 47/26
See application file for complete search history.

(56) References Cited

U.S. PATENT DOCUMENTS

| | | | |
|---|---|---|---|
| 3,231,488 | A | 1/1966 | Gatsis et al. |
| 4,244,839 | A | 1/1981 | Aldridge et al. |
| 4,354,852 | A | 10/1982 | Kydd |
| 4,457,831 | A | 7/1984 | Gendler |

(Continued)

FOREIGN PATENT DOCUMENTS

| | | | |
|---|---|---|---|
| CA | 1334840 | C | 3/1995 |
| FR | 3027909 | A1 | 5/2016 |

OTHER PUBLICATIONS

International Search Report PCT/EP2022/067625 dated Sep. 6, 2022 (pp. 1-2).

*Primary Examiner* — Renee Robinson
(74) *Attorney, Agent, or Firm* — Millen, White, Zelano & Branigan P.C.; Brion P. Heaney

(57) ABSTRACT

A hydroconversion process of a heavy oil feedstock comprises: (a) preparing a conditioned feedstock by mixing said heavy oil feedstock with a catalyst precursor formulation so that a colloidal or molecular catalyst is formed when it reacts with sulfur wherein the catalyst precursor formulation comprises a catalyst precursor composition containing Mo, an organic additive comprising a carboxylic acid function and/or an ester function and/or an acid anhydride function, wherein the molar ratio organic additive/Mo from formula- (Continued)

tion is between 0.1:1 and 20:1; (b) heating said conditioned feedstock; and (c) introducing the heated conditioned feedstock into at least one hybrid ebullated-entrained bed reactor comprising a hydroconversion porous supported catalyst, wherein the reactor is operated in the presence of hydrogen and at hydroconversion conditions to produce an upgraded material, the colloidal or molecular catalyst being formed during step (b) and/or (c).

21 Claims, 4 Drawing Sheets

(52) U.S. Cl.
CPC ..... *C10G 2300/1003* (2013.01); *C10G 2300/107* (2013.01); *C10G 2300/1077* (2013.01)

(56) References Cited

U.S. PATENT DOCUMENTS

| | | | |
|---|---|---|---|
| 4,495,060 | A | 1/1985 | Abrams |
| 4,521,295 | A | 6/1985 | Chervenak et al. |
| 4,637,870 | A | 1/1987 | Bearden, Jr. et al. |
| 4,637,871 | A | 1/1987 | Bearden, Jr. et al. |
| 5,108,581 | A | 4/1992 | Aldridge et al. |
| 6,043,182 | A | 3/2000 | Cordova et al. |
| 10,822,553 | B2 | 11/2020 | Lott |
| 10,941,353 | B2 | 3/2021 | Lott |
| 11,192,089 | B2 | 12/2021 | Corre et al. |
| 2005/0241991 | A1 | 11/2005 | Lott et al. |
| 2010/0044277 | A1 | 2/2010 | Kuperman et al. |
| 2014/0027344 | A1 | 1/2014 | Harris et al. |
| 2018/0195013 | A1 | 7/2018 | Dreillard et al. |
| 2019/0270074 | A1 | 9/2019 | Mathivet et al. |
| 2020/0115643 | A1* | 4/2020 | Rueter ..... B01J 8/0035 |

* cited by examiner

HYDROCONVERSION OF A HYDROCARBON-BASED HEAVY FEEDSTOCK IN A HYBRID EBULLATED-ENTRAINED BED, COMPRISING MIXING SAID FEEDSTOCK WITH A CATALYST PRECURSOR CONTAINING AN ORGANIC ADDITIVE

TECHNICAL FIELD

The present invention relates to a process for converting heavy oil feedstocks in the presence of hydrogen, a catalyst system comprising a porous supported catalyst and a colloidal or molecular catalyst, and an organic additive.

In particular, the present invention involves a process for hydroconversion of heavy oil feedstocks containing a fraction of at least 50% by weight having a boiling point of at least 300° C., and especially heavy oil feedstocks including a significant quantity of asphaltenes and/or fractions boiling above 500° C., such as crude oils or heavy hydrocarbon fractions resulting from the atmospheric and/or vacuum distillation of a crude oil, to yield lower boiling, higher quality materials.

The process specifically comprises mixing said heavy oil feedstock with a catalyst precursor formulation comprising an organic additive, before being sent into one or several hybrid ebullated bed reactors, in order to allow upgrading of this low-quality feedstock while minimizing fouling in equipment prior to hydroconversion in the hybrid ebullated bed reactor(s).

PRIOR ART

Converting heavy oil feedstocks into useful end products requires extensive processing, including reducing the boiling point of the heavy oil, increasing the hydrogen-to-carbon ratio, and removing impurities such as metals, sulfur, nitrogen and high carbon forming compounds.

Catalytic hydroconversion is commonly used for heavy oil feedstocks and is generally carried out using three-phase reactors in which the feedstock is brought into contact with hydrogen and a catalyst. In the reactor, the catalyst can be used in form of a fixed bed, a moving bed, an ebullated or an entrained bed, as for example described in chapter 18 "Catalytic Hydrotreatment and Hydroconversion: Fixed Bed, Moving Bed, Ebullated Bed and Entrained Bed" of the book "Heavy Crude Oils: From Geology to Upgrading, An Overview", published by Editions Technip in 2011. In the case of an ebullated bed or an entrained bed, the reactor comprises an upflow of liquid and of gas. The choice of the technology generally depends on the nature of the feedstock to process, and in particular its metal content, its tolerance for impurities and the conversion targeted.

Some heavy feedstock hydroconversion processes are based on hybrid technologies mixing the use of different catalyst bed types, for example hybrid processes using ebullated bed and entrained bed technologies, or fixed bed and entrained bed technologies, thus generally taking advantage of each technology.

For example, it is known from the art to use contemporarily in a same hydroconversion reactor a supported catalyst maintained in the ebullated bed in the reactor and an entrained catalyst of smaller size, also commonly known as a "slurry" catalyst, which is entrained out of the reactor with the effluents. This entrainment of the second catalyst is in particular enabled by a suitable density and a suitable particle size of the slurry catalyst. Hence a "hybrid ebullated-entrained bed" process, also herein called "hybrid ebullated bed" or simply "hybrid bed" process, is defined in the present description as referring to the implementation of an ebullated bed comprising an entrained catalyst in addition to a supported catalyst maintained in the ebullated bed, which can be seen as a hybrid operation of an ebullated bed and an entrained bed. The hybrid bed is in a way a mixed bed of two type of catalysts of necessarily different particle size and/or density, one type of catalyst being maintained in the reactor and the other type of catalyst, the slurry one, being entrained out of the reactor with the effluents. Such a hybrid bed hydroconversion process is known to improve the traditional ebullated bed process, in particular as the addition of a slurry catalyst reduces the formation of sediment and coke precursors in the hydroconversion reactor system.

Indeed, it is known that during operation of an ebullated bed reactor for upgrading heavy oil, the heavy oil is heated to a temperature at which the high boiling fractions of the heavy oil feedstock typically having a high molecular weight and/or low hydrogen/carbon ratio, an example of which is a class of complex compounds collectively referred to as "asphaltenes", tend to undergo thermal cracking to form free radicals of reduced chain length. These free radicals have the potential of reacting with other free radicals, or with other molecules to produce coke precursors and sediments. A slurry catalyst passing through the reactor from bottom to top, while the reactor already comprise a supported catalyst maintained into the reactor, provides an additional catalytic hydrogenation activity, especially in zones of the reactor generally free of supported catalyst. The slurry catalyst hence reacts with the free radicals in these zones, forming stable molecules, and thus contributes to control and reduce the formation of sediments and coke precursors. As formation of coke and sediments is a major cause of conventional catalyst deactivation and hydroconversion equipment fouling, such a hybrid process allows increasing the lifespan of the supported catalyst and prevents the fouling of downstream equipment, such as separation vessels, distillation columns, heat exchangers etc.

For example, PCT application WO2012/088025 describes such a hybrid process for upgrading heavy feedstocks using the ebullated bed technology and a catalytic system comprising of a supported catalyst and a slurry catalyst. The ebullated bed reactor comprises the two types of catalysts having different characteristics, the first catalyst having a size greater than 0.65 mm and occupying an expanded zone, and the second catalyst having an average size of 1-300 μm and being used in suspension. The second catalyst is introduced into the ebullated bed with the feed and passes through the reactor from bottom to top. It is prepared either from unsupported bulk catalysts or by crushing supported catalysts (grain size between 1 and 300 μm).

Patent document US2005/0241991 also relates to such a hybrid bed hydroconversion process for heavy oils, and discloses one or more ebullated bed reactors, which can operate in hybrid mode with the addition of a dispersed organosoluble metal precursor in the feedstock. The addition of the catalyst precursor, which can be pre-diluted in vacuum gas oil (VGO), is carried out in an intimate mixing stage with the feedstock for preparing a conditioned feedstock prior to its introduction into the first or subsequent ebullated bed reactors. It is specified that the catalyst precursor, typically molybdenum 2-ethylhexanoate, forms a colloidal or molecular catalyst (e.g. dispersed molybdenum sulfide) once heated, by reaction with $H_2S$ from the hydrodesulfurization of the feedstock. Such a process inhibits the formation of coke precursors and sediments that might otherwise deactivate the supported catalyst and foul the ebullated bed reactor and downstream equipment.

European patent application EP3723903 of the applicant also discloses a hybrid bed hydroconversion process for heavy oils, wherein the dispersed solid catalyst is obtained from at least one salt of a heteropolyanion combining molybdenum and at least one metal selected from cobalt and nickel in a Strandberg, Keggin, lacunary Keggin or substituted lacunary Keggin structure, improving hydrodeasphalting and leading to the reduction in the formation of sediments.

Slurry catalysts for heavy oil hydroconversion, and in particular colloidal or molecular catalysts formed by the use of soluble catalytic precursor, are well known in the art. It is known in particular that certain metal compounds, such as organosoluble compounds (e.g. molybdenum naphthenate or molybdenum octoate as cited in U.S. Pat. No. 4,244,839, US2005/0241991, US2014/0027344) or water-soluble compounds (e.g. phosphomolybdic acid cited in U.S. Pat. Nos. 3,231,488, 4,637,870 and 4,637,871; ammonium heptamolybdate cited in U.S. Pat. No. 6,043,182, salts of a heteropolyanion as cited in FR3074699), can be used as dispersed catalyst precursors and form catalysts. In case of water-soluble compounds, the dispersed catalyst precursor is generally mixed with the feedstock to form an emulsion. The dissolving of the dispersed catalyst (in general molybdenum) precursor, optionally promoted by cobalt or nickel in acid medium (in the presence of $H_3PO_4$) or basic medium (in the presence of $NH_4OH$), has been the subject of many studies and patents.

In addition to fouling due to coke precursors and sediments that can occur in the hybrid bed reactor and downstream equipment, the inventors have observed that fouling can also occur in equipment upstream, as soon as the heavy oil feedstock containing the catalyst precursor is heated before its introduction into the hydroconversion reactor.

Such a fouling in equipment upstream of the hydroconversion reactor, especially in the heating equipment of the heavy oil feedstock mixed with the catalyst precursor of the particular colloidal or molecular catalyst, seems to be mainly related to metal and carbon build-up on walls, and can limit equipment operability.

Thus, although the slurry catalyst in known hybrid processes such as those cited above is known to reduce fouling due to coke precursors and sediments in the hydroconversion reactor and downstream equipment, fouling observed in upstream equipment containing the heavy oil feedstock mixed with the catalyst precursor, such as in a preheating device, constitutes another operational issue not solved so far. Also, it has been observed that fouling due to coke precursors and sediments can still occur in downstream equipment in some cases, showing that the performance of the addition of a slurry catalyst can still be improved.

OBJECTIVES AND SUMMARY OF THE INVENTION

Within the context described above, an aim of the present invention is to provide a hybrid hydroconversion process implementing a colloidal or molecular catalyst formed by the use of soluble catalytic precursor, addressing the problem of fouling especially in equipment upstream the hydroconversion reactor, in particular in a preheating device of the feedstock prior its conversion in the hybrid hydroconversion reactor(s).

More generally, the present invention aims at providing a hybrid hydroconversion process for upgrading of heavy oil feedstocks allowing one or more of the following: more effective processing of asphaltene molecules, reduction in the formation of coke precursors and sediments, reduced equipment fouling, increased conversion level, enabling the reactor to process a wider range of lower quality feedstocks, elimination of catalyst-free zones in the ebullated bed reactor and downstream processing equipment, longer operation in between maintenance shut downs, more efficient use of the supported catalyst, increased throughput of heavy oil feedstock, and increased rate of production of converted products. Reducing the frequency of shutdown and startup of process vessels means less pressure and temperature cycling of process equipment, and it significantly increases the process safety and extends the useful life of expensive equipment.

Thus, in order to achieve at least one of the objectives targeted above, among others, the present invention provides, according to a first aspect, a process for the hydroconversion of a heavy oil feedstock (101) containing a fraction of at least 50% by weight having a boiling point of at least 300° C., and containing metals and asphaltenes, comprising the following steps:

(a) preparing a conditioned heavy oil feedstock by mixing said heavy oil feedstock with a catalyst precursor formulation in a manner so that a colloidal or molecular catalyst is formed when it reacts with sulfur, said catalyst precursor formulation comprising:
  - a catalyst precursor composition comprising molybdenum, and
  - an organic chemical compound comprising at least one carboxylic acid function and/or at least one ester function and/or an acid anhydride function, and the molar ratio between said organic chemical compound and molybdenum in said catalyst precursor formulation being comprised between 0.1:1 and 20:1;

(b) heating said conditioned heavy oil feedstock from step (a) in at least one preheating device;

(c) introducing said heated conditioned heavy oil feedstock from step (b) into at least one hybrid ebullated-entrained bed reactor comprising a hydroconversion porous supported catalyst and operating said hybrid ebullated-entrained bed reactor in the presence of hydrogen and at hydroconversion conditions to produce an upgraded material and wherein the colloidal or molecular catalyst is formed in situ within the conditioned heavy oil feedstock at step (b) and/or at step (c).

According to one or more embodiments, step (a) comprises simultaneously mixing said organic chemical compound with said catalyst precursor composition, preferably previously diluted with a hydrocarbon oil diluent, and with said heavy oil feedstock, preferably below a temperature at which a substantial portion of the catalyst precursor composition begins to thermally decompose, such as at a temperature comprise between room temperature and 300° C., and for a time period of 1 second to 30 minutes.

According to one or more embodiments, step (a) comprises (a1) pre-mixing said organic chemical compound with said catalyst precursor composition to produce said catalyst precursor formulation and (a2) mixing said catalyst precursor formulation with said heavy oil feedstock.

According to one or more embodiments, at step (a1) said catalyst precursor composition is mixed below a temperature at which a substantial portion of the catalyst precursor composition begins to thermally decompose, preferably at a temperature comprised between room temperature and 300° C.

According to one or more embodiments, a hydrocarbon oil diluent is used to form the catalyst precursor formulation, said hydrocarbon oil diluent being preferably selected from the group consisting of vacuum gas oil, decant oil or cycled oil, light gas oil, vacuum residues, deasphalted oils, and resins.

According to one or more embodiments, the organic chemical compound is selected from the group consisting of ethylhexanoic acid, naphthenic acid, caprylic acid, adipic acid, pimelic acid, suberic acid, azelaic acid, and sebacic acid, ethyl octanoate, ethyl 2-ethylhexanoate, 2-ethylhexyl 2-ethylhexanoate, benzyl 2-ethylhexanoate, diethyl adipate, dimethyl adipate, bis(2-ethylhexyl) adipate, dimethyl pimelate, dimethyl suberate, monomethyl suberate, hexanoic anhydride, caprylic anhydride, and a mixture thereof.

According to one or more embodiments, the organic chemical compound comprises 2-ethylhexanoic acid, and preferably is 2-ethylhexanoic acid.

According to one or more embodiments, the organic chemical compound comprises ethyl octanoate or 2-ethylhexyl 2-ethylhexanoate, and is preferably ethyl octanoate or 2-ethylhexyl 2-ethylhexanoate.

According to one or more embodiments, the catalyst precursor composition comprises an oil soluble organometallic compound or complex, preferably selected from the group consisting of molybdenum 2-ethylhexanoate, molybdenum naphthenate, molybdenum hexacarbonyl, and is preferably molybdenum 2-ethylhexanoate.

According to one or more embodiments, the molar ratio between said organic chemical compound and molybdenum of said catalyst precursor formulation is comprised between 0.75:1 and 7:1, and preferably between 1:1 and 5:1.

According to one or more embodiments, the colloidal or molecular catalyst comprises molybdenum disulfide.

According to one or more embodiments, step (b) comprising heating at a temperature comprised between 280° C. and 450° C., more preferably between 300° C. to 400° C., and most preferably in a range of 320° C. to 365° C.

According to one or more embodiments, the heavy oil feedstock comprises at least one of heavy crude oil, oil sand bitumen, atmospheric tower bottoms, vacuum tower bottoms, resid, visbreaker bottoms, coal tar, heavy oil from oil shale, liquefied coal, heavy bio oils, and heavy oils comprising plastic waste and/or a plastic pyrolysis oil.

According to one or more embodiments, the heavy oil feedstock has a sulfur at a content of greater than 0.5% by weight, a Conradson carbon residue of at least 0.5% by weight, $C_7$ asphaltenes at a content of greater than 1% by weight, transition and/or post-transition and/or metalloid metals at a content of greater than 2 ppm by weight, and alkali and/or alkaline earth metals at a content of greater than 2 ppm by weight.

According to one or more embodiments, step (c) is carried out under an absolute pressure of between 2 MPa and 38 MPa, at a temperature of between 300° C. and 550° C., at an liquid hourly space velocity LHSV relative to the volume of each hybrid reactor of between 0.05 $h^{-1}$ and 10 $h^{-1}$ and under an amount of hydrogen mixed with the feedstock entering hybrid bed reactor of between 50 and 5000 $Nm^3/m^3$ of feedstock.

According to one or more embodiments, the concentration of molybdenum in the conditioned oil feedstock is in a range of 5 ppm to 500 ppm by weight of the heavy oil feedstock.

According to one or more embodiments, the hydroconversion porous supported catalyst contains at least one metal from the non-noble group VIII chosen from nickel and cobalt, preferably nickel, and at least one metal from group VIB chosen from molybdenum and tungsten, preferably molybdenum, and includes an amorphous support, preferably an alumina support.

According to one or more embodiments, the process comprises a step (d) of further processing the upgraded material, said step (d) comprising:

a second hydroconversion step in a second hybrid ebullated-entrained bed reactor of at least a portion or all of the upgraded material resulting from the hydroconversion step (c) or optionally of a liquid heavy fraction that boils predominantly at a temperature greater than or equal to 350° C. resulting from an optional separation step separating a portion or all of the upgraded material resulting from the hydroconversion step (c), said second hybrid ebullated-entrained bed reactor comprising a second porous supported catalyst and operating in the presence of hydrogen and at hydroconversion conditions to produce a hydroconverted liquid effluent with a reduced heavy residue fraction, a reduced Conradson carbon residue and eventually a reduced quantity of sulfur, and/or nitrogen, and/or metals, a step of fractionating a portion or all of said hydroconverted liquid effluent in a fractionation section (F) to produce at least one heavy cut that boils predominantly at a temperature greater than or equal to 350° C., said heavy cut containing a residual fraction that boils at a temperature greater than or equal to 540° C.;

an optional step of deasphalting a portion or all of said heavy cut resulting with at least one hydrocarbon solvent to produce a deasphalted oil DAO and a residual asphalt; and wherein, said hydroconversion step (c) and said second hydroconversion step are carried out under an absolute pressure of between 2 and 38 MPa, at a temperature of between 300° C. and 550° C., at an hourly space velocity HSV relative to the volume of each hybrid ebullated-entrained bed reactor of between 0.05 $h^{-1}$ and 10 $h^{-1}$ and under an amount of hydrogen mixed with the feedstock entering each hybrid ebullated-entrained bed reactor of between 50 and 5000 $Nm^3/m^3$ of feedstock.

Other subjects and advantages of the invention will become apparent on reading the description which follows of specific exemplary embodiments of the invention, given by way of non-limiting examples, the description being made with reference to the appended figures described below.

DESCRIPTION OF THE EMBODIMENTS

Figure 1:
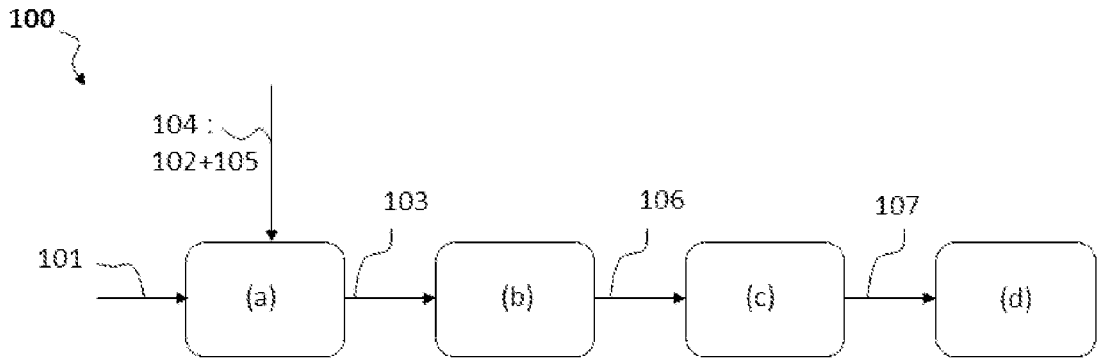
FIG. 1 is a block diagram illustrating the principle of the hybrid bed hydroconversion process according to the invention.

The object of the invention is to provide hybrid bed hydroconversion methods and systems for improving the quality of a heavy oil feedstock.

Such methods and systems for hydro converting heavy oil feedstocks employ a dual catalyst system that includes a molecular or colloidal catalyst dispersed within the heavy oil feedstock and a porous supported catalyst. They also employ an organic additive added in a catalyst precursor formulation that is mixed with the heavy oil feedstock, prior to operating the dual catalyst system in one or more ebullated bed reactors, each of which comprising a solid phase comprising an expanded bed of a porous supported catalyst, a liquid hydrocarbon phase comprising the heavy oil feedstock, the colloidal or molecular catalyst dispersed therein and the organic additive, and a gaseous phase comprising hydrogen gas.

The hybrid bed hydroconversion methods and systems of the invention reduce equipment fouling, and especially fouling in equipment upstream the hybrid hydroconversion reactor(s), in particular in preheating equipment of the feedstock prior its conversion in the hybrid hydroconversion reactor(s), and can effectively process asphaltenes, reduce or eliminate the formation of coke precursors and sediments, increase conversion level especially by allowing hydroconversion to be operated at high temperature, and eliminate catalyst-free zones that would otherwise exist in conventional ebullated bed hydroconversion reactor(s) and downstream processing equipment. The hybrid bed hydroconversion methods and systems of the invention also allows more efficient usage of the porous supported catalyst, and of the combined dual catalyst system.

Terminology

Some definitions are given below, although more details on the objects hereafter defined shall be given further in the description.

The term "hydroconversion" shall refer to a process whose primary purpose is to reduce the boiling range of a heavy oil feedstock and in which a substantial portion of the feedstock is converted into products with boiling ranges lower than that of the original feedstock.

Hydroconversion generally involves fragmentation of larger hydrocarbon molecules into smaller molecular fragments having a fewer number of carbon atoms and a higher hydrogen-to-carbon ratio. Reactions implemented during hydroconversion allow the size of hydrocarbon molecules to be reduced, mainly by cleavage of carbon-carbon bonds, in the presence of hydrogen in order to saturate the cut bonds and aromatic rings. The mechanism by which hydroconversion occurs typically involves the formation of hydrocarbon free radicals during fragmentation mainly by thermal cracking, followed by capping of the free radical ends or moieties with hydrogen in the presence of active catalyst sites. Of course, during a hydroconversion process other reactions typically associated with "hydrotreating" can occur such as the removal of sulfur and nitrogen from the feedstock as well as olefin saturation.

The term "hydrocracking" is often used as a synonym for "hydroconversion" according to the English terminology, although "hydrocracking" shall rather refer to a process similar to hydroconversion but in which cracking of hydrocarbon molecules is mainly a catalytic cracking, that is a cracking occurring in the presence of a hydrocracking catalyst having a phase responsible for the cracking activity, for example acidic sites as for example contained in clay or zeolites. According to the French terminology for example, hydrocracking which can be translated as "hydrocraquage" generally refers to this last definition (catalytic cracking), and its usage is for example rather reserved for the case of vacuum distillates as oil feedstocks to be converted, whereas the French term "hydroconversion" is generally reserved for the conversion of heavy oils feedstocks like atmospheric and vacuum residues (but not only).

The term "hydrotreating" shall refer to a milder operation whose primary purpose is to remove impurities such as sulfur, nitrogen, oxygen, halides, and trace metals from the feedstock and saturate olefins and/or stabilize hydrocarbon free radicals by reacting them with hydrogen rather than allowing them to react with themselves. The primary purpose is not to change the boiling range of the feedstock. Hydrotreating is most often carried out using a fixed bed reactor, although other hydroprocessing reactors can also be used for hydrotreating, an example of which is an ebullated bed hydrotreatment reactor.

The term "hydroprocessing" shall broadly refer to both "hydroconversion"/"hydrocracking" and "hydrotreating" processes.

The term "hydroconversion reactor" shall refer to any vessel in which hydroconversion of a feedstock is the primary purpose, e.g. the cracking of the feed (i.e. reducing the boiling range), in the presence of hydrogen and a hydroconversion catalyst. Hydroconversion reactors typically comprise an input port into which a heavy oil feedstock and hydrogen can be introduced, an output port from which an upgraded material can be withdrawn.

Specifically, hydroconversion reactors are also characterized by having sufficient thermal energy in order to cause fragmentation of larger hydrocarbon molecules into smaller molecules by thermal decomposition. Examples of hydroconversion reactors include, but are not limited to, slurry bed reactors, also known as entrained bed reactors (three phase-liquid, gas, solid—reactors, wherein the solid and liquid phases can behave like a homogeneous phase), ebullated bed reactors (three phase fluidized reactors), moving bed reactors (three phase reactors with downward movement of the solid catalyst and upward or downward flow of liquid and gas), and fixed bed reactors (three phase reactors with liquid feed trickling downward over a fixed bed of solid supported catalyst with hydrogen typically flowing concurrently with the liquid, but possibly countercurrently in some cases).

The terms "hybrid bed" and "hybrid ebullated bed" and "hybrid entrained-ebullated bed" for a hydroconversion reactor shall refer to an ebullated bed hydroconversion reactor comprising an entrained catalyst in addition to a porous supported catalyst maintained into the ebullated bed reactor. Similarly, for a hydroconversion process, these terms shall thus refer to a process comprising a hybrid operation of an ebullated bed and an entrained bed in at least a same hydroconversion reactor. The hybrid bed is a mixed bed of two type of catalysts of necessarily different particle size and/or density, one type of catalyst—the "porous supported catalyst"—being maintained in the reactor and the other type of catalyst—the entrained catalyst", also commonly referred as "slurry catalyst"—being entrained out of the reactor with the effluents (upgraded feedstock). In the present invention, the entrained catalyst is a colloidal catalyst or molecular catalyst, as defined below.

The terms "colloidal catalyst" and "colloidally dispersed catalyst" shall refer to catalyst particles having a particle size that is colloidal in size, e.g. less than about 100 nm in diameter, preferably less than about 10 nm in diameter, more preferably less than about 5 nm in diameter, and most preferably less than about 1 nm in diameter. The term "colloidal catalyst" includes, but is not limited to, molecular or molecularly-dispersed catalyst compounds.

The terms "molecular catalyst" and "molecularly dispersed catalyst" shall refer to catalyst compounds that are essentially "dissolved" or completely dissociated from other catalyst compounds or molecules in a heavy oil hydrocarbon feedstock, non-volatile liquid fraction, bottoms fraction, resid, or other feedstock or product in which the catalyst may be found. It shall also refer to very small catalyst particles or slabs that only contain a few catalyst molecules joined together (e.g. 15 molecules or less).

The terms "porous supported catalyst", "solid supported catalyst", and "supported catalyst" shall refer to catalysts that are typically used in conventional ebullated bed and fixed bed hydroconversion systems, including catalysts designed primarily for hydrocracking or hydrodemetallization and catalysts designed primarily for hydrotreating. Such catalysts typically comprise (i) a catalyst support having a large surface area and numerous interconnected channels or pores and (ii) fine particles of an active catalyst such as sulfides of cobalt, nickel, tungsten, and molybdenum dispersed within the pores. Supported catalysts are commonly produced as cylindrical pellets or spherical solids, although other shapes are possible.

The terms "upgrade", "upgrading" and "upgraded", when used to describe a feedstock that is being or has been subjected to hydroconversion, or a resulting material or product, shall refer to one or more from among: a reduction in the molecular weight of the feedstock, a reduction in the boiling point range of the feedstock, a reduction in the concentration of asphaltenes, a reduction in the concentration of hydrocarbon free radicals, a reduction of Conradson carbon residue, an increase of H/C atomic ratio of the feedstock, and a reduction in the quantity of impurities, such as sulfur, nitrogen, oxygen, halides, and metals.

The terms "conditioned feedstock" and "conditioned heavy oil feedstock" shall refer to the heavy oil feedstock to be treated into at least a hydroconversion hybrid bed reactor, feedstock in which a catalyst precursor formulation comprising a catalyst precursor composition and an organic additive has been combined and mixed sufficiently so that, upon formation of the catalyst, especially by reaction with sulfur, the catalyst will comprise a colloidal or molecular catalyst dispersed within the feedstock.

The term "active mixing device" shall refer to a mixing device comprising a mobile part, e.g. a stirring rod or propeller or turbine impeller, to actively mix the components.

In what follows, the term "comprise" is synonymous with (means the same thing as) "include" and "contain", and is inclusive or open and does not exclude other unspecified elements. It will be understood that the term "comprise" includes the exclusive and closed term "consist".

The terms "comprised between . . . and . . . " and "in the . . . to . . . range" and "in a range of . . . to . . . " mean that the values at the limits of the interval are included in the range of values described, unless specified otherwise.

In the detailed description below, numerous specific details are set out in order to convey a deeper understanding of the process and system according to the invention. However, it will be apparent to the skilled person that the process and system can be employed without all these specific details. In other cases, characteristics which are well known have not been described in detail, in order not to complicate the description to no purpose.

FIG. 1 is a block diagram schematically illustrating the principle of the hybrid bed hydroconversion process 100 according to the invention. It differs in particular from a conventional hybrid bed process as disclosed for example in US2005/0241991 in that the catalyst precursor formulation comprises an organic additive when mixed with the oil feedstock, said catalyst precursor formulation also comprising a catalyst precursor composition comprising molybdenum and having a specific molar ratio of the organic additive to molybdenum.

The terms "organic chemical compound" and "organic additive" are indifferently used in the present description to designate the organic chemical compound comprising at least one carboxylic acid function and/or at least one ester function and/or an acid anhydride function added in the catalyst precursor formulation mixed with the heavy oil feedstock at step (a), and described in details further below. The organic additive is a compound in addition to any possible organic compound initially present in the catalyst precursor composition.

According to the invention, a heavy oil feedstock 101 containing a fraction of at least 50% by weight having a boiling point of at least 300° C., and containing metals and asphaltenes, is treated in a hydroconversion process 100 comprising the following steps:

(a) preparing a conditioned heavy oil feedstock 103 by mixing said heavy oil feedstock 101 with a catalyst precursor formulation 104 in a manner so that a colloidal or molecular catalyst is formed when it reacts with sulfur, said catalyst precursor formulation 104 comprising:
   - a catalyst precursor composition 105 comprising molybdenum, and
   - an organic chemical compound 102 comprising at least one carboxylic acid function and/or at least one ester function and/or an acid anhydride function, and
   - a molar ratio between said organic chemical compound 102 and molybdenum comprised between 0.1:1 and 20:1;

(b) heating the conditioned heavy oil feedstock 103 from step (a) by at least one preheating device;

(c) introducing the heated conditioned heavy oil feedstock 106 from step (b) into at least one hybrid ebullated-entrained bed reactor comprising a hydroconversion porous supported catalyst and operating said hybrid ebullated-entrained bed reactor in the presence of hydrogen and at hydroconversion conditions to produce an upgraded material 107.

The upgraded material 107 can be further processed in optional step (d).

In the hydroconversion process according to the invention, the colloidal or molecular catalyst is formed in situ within the conditioned heavy oil feedstock at step (b) and/or at step (c).

Each step, stream and material involved are now detailed below.

Some of the numerical references mentioned below relate to FIG. 6, which illustrates schematically an example of a hybrid bed hydroconversion system 600 according to the invention, said system being described in detail later in the description, after the description of the general process.

Heavy Oil Feedstock

The term "heavy oil feedstock" shall refer to heavy crude oils, oil sand bitumen, bottom of the barrel and resid left over from refinery processes (e.g. visbreaker bottoms), and any other lower quality material that contains a substantial quantity of high boiling hydrocarbon fractions and/or that includes a significant quantity of asphaltenes that can deactivate a solid supported catalyst and/or cause or result in the formation of coke precursors and sediments.

The heavy oil feedstock 101 can thus comprise at least one of the following feedstocks: heavy crude oil, oil sand bitumen, atmospheric tower bottoms, vacuum tower bottoms, resid, visbreaker bottoms, coal tar, heavy oil from oil shale, liquefied coal, heavy bio oils, and heavy oils comprising plastic waste and/or a plastic pyrolysis oil.

Plastic pyrolysis oils are oils obtained from the pyrolysis of plastics, preferably of plastic waste, and may be obtained from a thermal, catalytic pyrolysis treatment or else may be prepared by hydropyrolysis (pyrolysis in the presence of a catalyst and of hydrogen).

In particular, the treated heavy oil feedstock contains hydrocarbon fractions of which at least 50% by weight, preferably at least 80% by weight has a boiling temperature of at least 300° C., preferably at least 350° C. or at least 375° C.

These are crude oils or heavy hydrocarbon fractions resulting from the atmospheric and/or vacuum distillation of a crude oil. They can also be atmospheric and/or vacuum residues, and in particular atmospheric and/or vacuum residues resulting from hydrotreatment, hydrocracking and/or hydroconversion. It can also be vacuum distillates, cuts from a catalytic cracking unit such as fluid catalytic cracking (FCC), a coking or visbreaking unit.

Preferably, they are vacuum residues. Generally these residues are fractions in which at least 80% by weight has a boiling temperature of at least 450° C. or more, and most often at least 500° C. or 540° C.

Aromatic cuts extracted from a lubricant production unit, deasphalted oils (raffinates from a deasphalting unit), and asphalt (residues from a deasphalting unit) are also suitable as feedstock.

The feedstock can also be a residual fraction from direct coal liquefaction (vacuum distillate and/or atmospheric and/or vacuum residue from e.g. H-Coal process, registered trademark), coal pyrolysis or shale oil residues, or a residual fraction from the direct liquefaction of lignocellulosic biomass alone or mixed with coal and/or a petroleum fraction (herein called "heavy bio oils").

Examples of heavy oil feedstocks include, but are not limited to Lloydminster heavy oil, Cold Lake bitumen, Athabasca bitumen, Urals crude oil, Arabian Heavy crude oil, Arabian Light crude oil, atmospheric tower bottoms, vacuum tower bottoms, residuum (or "resid"), resid pitch, vacuum residue, solvent deasphalting pitch, and nonvolatile liquid fractions that remain after subjecting crude oil, bitumen from tar sands, liquefied coal, oil shale, or coal tar feedstocks to distillation, hot separation, and the like and that contain higher boiling fractions and/or asphaltenes.

All these feedstocks can be used alone or in a mixture.

The above heavy oil feedstocks treated in the process and system according to the invention contain metals and asphaltenes, in particular $C_7$ asphaltenes, and other impurities such as sulfur and nitrogen.

The term "asphaltene" shall refer to the fraction of a heavy oil feedstock that is typically insoluble in paraffinic solvents such as propane, butane, pentane, hexane, and heptane and that includes sheets of condensed cyclic compounds held together by hetero atoms such as sulfur, nitrogen, oxygen and metals. Asphaltenes broadly include a wide range of complex compounds having anywhere from 80 to 160,000 carbon atoms. Asphaltenes are defined operationally as "$C_7$ asphaltenes", i.e. heptane-insoluble compounds according to the standard ASTM D 6560 (also corresponding to standard NF T60-115), and any content in asphaltenes refers to $C_7$ asphaltenes in the present description. $C_7$ asphaltenes are compounds known to inhibit the conversion of residual cuts, both by their ability to form heavy hydrocarbon residues, commonly known as coke, and by their tendency to produce sediments that severely limit the operability of hydrotreating and hydroconversion units.

The heavy oil feedstock 101 can typically have sulfur at a content of greater than 0.5% by weight, Conradson carbon residue of at least 3% by weight, $C_7$ asphaltenes at a content of greater than 1% by weight, transition and/or post-transition and/or metalloid metals at a content of greater than 2 ppm by weight, and alkali and/or alkaline earth metals at a content of greater than 2 ppm by weight.

These types of feedstocks are indeed generally rich in impurities such as metals, in particular transition metal (e.g. Ni, V) and/or post-transition metal, and/or metalloid, for which a content can be greater than 2 ppm by weight, or greater than 20 ppm by weight, and even greater than 100 ppm by weight, and also alkali metal (e.g. Na) and/or alkaline earth metal whose content can be higher than 2 ppm by weight, even higher than 5 ppm by weight, and even higher than 7 ppm or 10 ppm by weight.

The sulfur content is indeed generally higher than 0.5% by weight, and even higher than 1% by weight, or even greater than 2% by weight.

The content of $C_7$ asphaltenes can indeed be at least 1% by weight, and even higher than 3% by weight.

The Conradson carbon residue is indeed in general higher than 3% by weight, and even of at least 5% by weight. The Conradson carbon residue is defined by ASTM D 482 standard and represents the amount of carbon residue produced after pyrolysis under standard conditions of temperature and pressure.

These contents are expressed in % by weight of the total weight of the feed.

Step (a): Conditioned Heavy Oil Feedstock Preparation

Step (a) comprises mixing said heavy oil feedstock 101 with a catalyst precursor formulation 104 in a manner so that a colloidal or molecular catalyst is formed when it will react with sulfur. This blending forms what is referred to herein as the conditioned heavy oil feedstock 103.

The catalyst precursor formulation 104 comprises a catalyst precursor composition 105 comprising molybdenum, and an organic chemical compound 102 comprising at least one carboxylic acid function and/or at least one ester function and/or an acid anhydride function.

The molar ratio between said organic chemical compound 102 and molybdenum is comprised between 0.1:1 and 20:1.

This step comprises a thorough mixing with the catalyst precursor formulation that will lead to the formation of a colloidal or molecular catalyst dispersed within the heavy oil.

According one or more embodiments, a hydrocarbon oil diluent is used to form the catalyst precursor formulation 104. Preferably, said hydrocarbon oil diluent is selected from the group consisting of vacuum gas oil, decant oil or cycled oil, light gas oil, vacuum residues, deasphalted oils, and resins, as detailed further below, and is preferably a vacuum gas oil.

The inventors have shown that this mixing step (a) improves the hybrid ebullated-entrained bed hydroconversion process, in particular by reducing the fouling of the equipment, especially upstream the hybrid hydroconversion reactor in the feedstock heating equipment at step b).

Without being bound by any theory, the presence of the organic additive during the mixing of the heavy oil feedstock with the catalyst precursor composition, allows a better solubility of the colloidal or molecular catalyst precursor in the feed, avoiding or reducing fouling in particular due to metal deposition in equipment upstream the hybrid hydroconversion reactor like in the heating equipment, and improving therefore the dispersion of the colloidal or molecular catalyst formed at step b) and/or at a later stage, thus generating a greater availability of the metal active sites, favoring the hydrogenation of free radicals which are precursors of coke and sediments, and generating a substantial reduction of the fouling of the equipment.

The Organic Additive

The organic additive 102 having at least one carboxylic acid function and/or at least one ester function and/or an acid anhydride function preferably comprises at least 6 carbon atoms, and more preferably at least 8 carbon atoms.

Typically, the organic additive 102 is not a catalyst precursor nor a catalyst.

In particular, the organic additive 102 does not contain any metal.

Examples of organic additive include, but are not limited to, 2-ethylhexanoic acid, naphthenic acid, caprylic acid, adipic acid, pimelic acid, suberic acid, azelaic acid, sebacic acid, ethyl octanoate, ethyl 2-ethylhexanoate, 2-ethylhexyl 2-ethylhexanoate, benzyl 2-ethylhexanoate, diethyl adipate, dimethyl adipate, bis(2-ethylhexyl) adipate, dimethyl pimelate, dimethyl suberate, monomethyl suberate, hexanoic anhydride, caprylic anhydride. Advantageously, the organic additive is an organic chemical compound selected from the group consisting of the list of specific compounds recited just above, and a mixture thereof.

Preferably, the organic additive is an organic chemical compound comprising at least one carboxylic acid function, and more preferably selected from the group consisting of 2-ethylhexanoic acid, naphthenic acid, caprylic acid, adipic acid, pimelic acid, suberic acid, azelaic acid, and sebacic acid.

More preferably, the organic additive comprises, or consists of, 2-ethylhexanoic acid.

The organic additive can be an organic chemical compound comprising at least one ester function and/or an acid anhydride function, and for example selected from the group consisting of ethyl octanoate, ethyl 2-ethylhexanoate, 2-ethylhexyl 2-ethylhexanoate, benzyl 2-ethylhexanoate, diethyl adipate, dimethyl adipate, bis(2-ethylhexyl) adipate, dimethyl pimelate, dimethyl suberate, monomethyl suberate, and/or from the group consisting of hexanoic anhydride and caprylic anhydride.

More preferably, the organic additive comprising at least one ester function and/or an acid anhydride function comprises, or consists of, ethyl octanoate or 2-ethylhexyl 2-ethylhexanoate or a mixture thereof, and preferably is ethyl octanoate or 2-ethylhexyl 2-ethylhexanoate.

The organic additive is added such that the molar ratio of organic additive to molybdenum (brought by the catalyst precursor compound, e.g. molybdenum 2-ethylhexanoate) in the catalyst precursor formulation 104 is in a range of about 0.1:1 to about 20:1, preferably in a range of about 0.75:1 to about 7:1, and more preferably in a range of about 1:1 to about 5:1. The term "about" shall refer to an approximation of ±5%, preferably ±1%.

Catalyst Precursor Formulation

The catalyst precursor formulation comprises a catalyst precursor composition selected from all metal catalyst precursors containing molybdenum known to a person skilled in the art, capable of forming a colloidally or molecular dispersed catalyst (i.e. the slurry catalyst) in the presence of hydrogen and/or $H_2S$ and/or any other source of sulfur, and enabling the hydroconversion of a heavy oil feedstock after injection into said heavy oil feedstock.

The catalyst precursor composition containing molybdenum is advantageously an oil soluble catalyst precursor composition at least containing one transition metal.

The catalyst precursor composition preferably comprises an oil soluble organo-metallic compound or complex.

The oil soluble catalyst precursor composition preferably has a decomposition temperature (temperature under which the catalyst precursor composition is substantially chemically stable) in a range from 100° C. to 350° C., more preferably in a range of 150° C. to 300° C., and most preferably in a range of 175° C. to 250° C.

The oil soluble organo-metallic compound or complex is preferably selected from the group consisting of molybdenum 2-ethylhexanoate, molybdenum naphthenate, and molybdenum hexacarbonyl.

These compounds are non-limiting examples of oil soluble catalyst precursor compositions.

A currently preferred catalyst precursor composition is molybdenum 2-ethylhexanoate (also commonly known as molybdenum octoate). Typically, molybdenum 2-ethylhexanoate contains 15% by weight of molybdenum and has a decomposition temperature or range high enough to avoid substantial thermal decomposition when mixed with a heavy oil feedstock at a temperature below 250° C.

One of skill in the art can, following the present disclosure, select a mixing temperature profile that results in mixing of a selected precursor composition without substantial thermal decomposition prior to formation of the colloidal or molecular catalyst.

Incorporation of the Organic Additive

The mixing step (a) can be carried out according to different manners detailed below, mainly depending on whether the organic additive is mixed simultaneously with the heavy oil feedstock and the catalyst precursor composition, or is introduced in a sequential manner, in particular by premixing the catalyst precursor composition with the organic additive to form the catalyst precursor formulation before its mixing with the heavy oil feedstock.

The mixing step (a) advantageously comprises the operation of at least a conditioner mixer 610 configured to provide a thorough mixing between the feedstock and the catalyst precursor formulation 104 to form the conditioned heavy oil feedstock.

First Embodiment: Simultaneous Mixing of Oil Feedstock, Organic Additive and Catalyst Precursor Composition According to a first embodiment, step (a) comprises simultaneously mixing the organic additive 102 with the catalyst precursor composition 105, preferably previously diluted with a hydrocarbon oil diluent, and with the heavy oil feedstock 101.

According to this embodiment, the catalyst precursor formulation 104, comprising the catalyst precursor composition 105, preferably previously diluted, and the organic additive 102 is thus formed during the mixing with the heavy oil feedstock 101.

The organic additive is added such that the molar ratio of organic additive to molybdenum (brought by the catalyst precursor composition, e.g. molybdenum 2-ethylhexanoate) is in a range of about 0.1:1 to about 20:1, preferably in a range of about 0.75:1 to about 7:1, and more preferably in a range of about 1:1 to about 5:1, as previously mentioned.

Such a simultaneous mixing is preferably carried out below a temperature at which a substantial portion of the catalyst precursor composition begins to thermally decompose, such as at a temperature comprised between room temperature, e.g. 15° C., and 300° C., more preferably comprised between 50° C. and 200° C., and even more preferably comprised between 75° C. and 175° C.

Such a simultaneous mixing is performed for a time sufficient and in a manner so as to disperse the catalyst precursor even more preferably throughout the feedstock in order to yield a conditioned heavy oil feedstock 103 in which the catalyst precursor composition is thoroughly mixed within the heavy oil feedstock.

Preferably, the gauge pressure is comprised between 0 MPa and 25 MPa, more preferably comprised between 0.01 MPa and 5 MPa.

In order to obtain sufficient mixing of the catalyst precursor composition within the heavy oil feedstock before forming the colloidal or molecular catalyst, the simultaneous mixing of the heavy oil feedstock 101, the organic additive 102 and the catalyst precursor composition 105, advantageously diluted with a hydrocarbon diluent, is preferably carried out for a time period in the range of 1 second to 30 minutes, more preferably of 1 second to 10 minutes, and most preferably in a range of 2 seconds to 3 minutes. In the present description, a mixing time (or residence time for mixing) of 1 second includes an instantaneous mixing.

Whereas it is within the scope of the invention to directly blend the catalyst precursor composition 105 with the heavy oil feedstock 101 and the organic additive 102, care must be taken in such cases to mix the components for a time sufficient to thoroughly blend the catalyst precursor composition within the feedstock before forming the catalyst. However, long time mixing, for example 24-hour mixing, can make certain industrial operations prohibitively expensive.

Hence, according to the first embodiment, step (a) preferably comprises a dilution of the catalyst precursor composition 105 prior to the simultaneous mixing with the heavy oil feedstock 101 and the organic additive 102: pre-dilution of the catalyst precursor composition 105 with a hydrocarbon diluent prior to simultaneous mixing of said diluted catalyst precursor composition with the heavy oil feedstock and the organic additive 102 greatly aids in thoroughly and intimately blending the catalyst precursor composition within the feedstock, particularly in the relatively short period of time required for large-scale industrial operations to be economically viable.

Such a mixing of a catalyst precursor composition, preferably the oil soluble catalyst precursor composition, with a diluent hydrocarbon stream is for example described in US2005/0241991 and recalled below.

Providing a diluted catalyst precursor composition shortens the overall mixing time by (1) reducing or eliminating differences in solubility between the more polar catalyst precursor composition and the heavy oil feedstock, (2) reducing or eliminating differences in rheology between the catalyst precursor composition and the heavy oil feedstock, and/or (3) breaking up the catalyst precursor molecules to form a solute within a hydrocarbon oil diluent that is much more easily dispersed within the heavy oil feedstock. It is particularly advantageous to first form a diluted catalyst precursor composition in the case where the heavy oil feedstock contains water (e.g. condensed water). Otherwise, the greater affinity of the water for the polar catalyst precursor composition can cause localized agglomeration of the catalyst precursor composition, resulting in poor dispersion and formation of micron-sized or larger catalyst particles. The hydrocarbon oil diluent is preferably substantially water free (i.e.; contains less than 0.5% by weight of water, preferably less than 0.1% by weight of water, and more preferably less than 750 ppm by weight of water) to prevent the formation of substantial quantities of micron-sized or larger catalyst particles.

Examples of suitable hydrocarbon diluents include, but are not limited to, vacuum gas oil known as "VGO" (which typically has a boiling range of 360° C.-524° C.), decant oil or cycled oil (which typically has a boiling range of 360° C.-550° C.), light gas oil (which typically has a boiling range of 200° C.-360° C.), vacuum residues (which typically has a boiling temperature of 524° C.+), deasphalted oils, and resins.

The mass ratio of catalyst precursor composition 105 to hydrocarbon oil diluent is preferably in a range of 1:500 to 1:1, more preferably in a range of 1:150 to 1:2, and most preferably in a range of 1:100 to 1:5 (e.g. 1:100, 1:50, 1:30, or 1:10).

Said dilution prior to the simultaneous mixing is advantageously carried out for a time period of 1 second to 30 minutes, preferably in a range of 1 second to 10 minutes, and most preferably in a range of 2 seconds to 3 minutes. The actual time for this dilution is dependent, at least in part, on the temperature (i.e., which affects the viscosity of the fluids) and intensity of mixing carried out for the dilution.

Said dilution is also advantageously carried out below a temperature at which a substantial portion of the catalyst precursor composition begins to thermally decompose, preferably at a temperature comprised between room temperature, e.g. 15° C. and 300° C., more preferably comprised between room temperature and 200° C., even more preferably comprised between 50° C. and 200° C., most preferably comprised between 75° C. and 150° C., and even more preferably between 75° C. and 100° C.

It will be appreciated that the actual temperature at which the diluted catalyst precursor composition 105 is formed typically depends largely on the decomposition temperature of the particular precursor composition that is utilized.

The conditioner mixer 610 can comprise an active mixing device, any injection system for pipes or any in-line mixer as detailed below.

The simultaneous mixing of step (a) according to the first embodiment can be carried out in a dedicated vessel of an active mixing device forming the conditioner mixer 610.

Such a configuration can in particular increase the dispersion of the colloidal or molecular catalyst formed in a later stage. The use of a dedicated vessel also enables a long residence time.

Such a simultaneous mixing can alternatively comprise injecting said organic additive 102 and the catalyst precursor composition 105, preferably previously diluted with a hydrocarbon oil diluent, into a pipe conveying the heavy oil feedstock 101 towards the hybrid ebullated-entrained bed reactor. The conditioner mixer 610 thus comprises in such a configuration the portion(s) of the pipe wherein the mixing is performed, and possibly additional systems to help the mixing, as for example static in-line mixers or high-shear in-line mixers as further described. Such a configuration can in particular reduce equipment investment and required footprint compared to mixing in a dedicated vessel.

The conditioner mixer 610 used for the simultaneous mixing can also comprise a combination of such a dedicated vessel of an active mixing device and in-pipe injection systems possibly comprising static and/or high-shear in-line mixers.

Examples of mixing apparatus that can be used to effect thorough simultaneous mixing of the catalyst precursor composition 105, preferably diluted, with the heavy oil feedstock 101 and the organic additive 102 include, but are not limited to, high shear mixing such as mixing created in a pump with a propeller or turbine impeller; multiple static in-line mixers; multiple static in-line mixers in combination with in-line high shear mixers; multiple static in-line mixers in combination with in-line high shear mixers; multiple static in-line mixers in combination with in-line high shear mixers followed by a pump around in the surge vessel; combinations of the above followed by one or more multi-stage centrifugal pumps. According to one embodiment, continuous rather than batch-wise mixing can be carried out using high energy pumps having multiple chambers within which the catalyst precursor composition 105, preferably diluted, the heavy oil feedstock 101 and the organic additive 102 are churned and mixed as part of the pumping process itself. The foregoing mixing apparatus may also be used for the dilution stage discussed above in which the catalyst precursor composition 105 is mixed with the hydrocarbon oil diluent.

Increasing the vigorousness and/or shearing energy of the simultaneous mixing process generally reduce the time required to effect thorough mixing.

Figure 2:
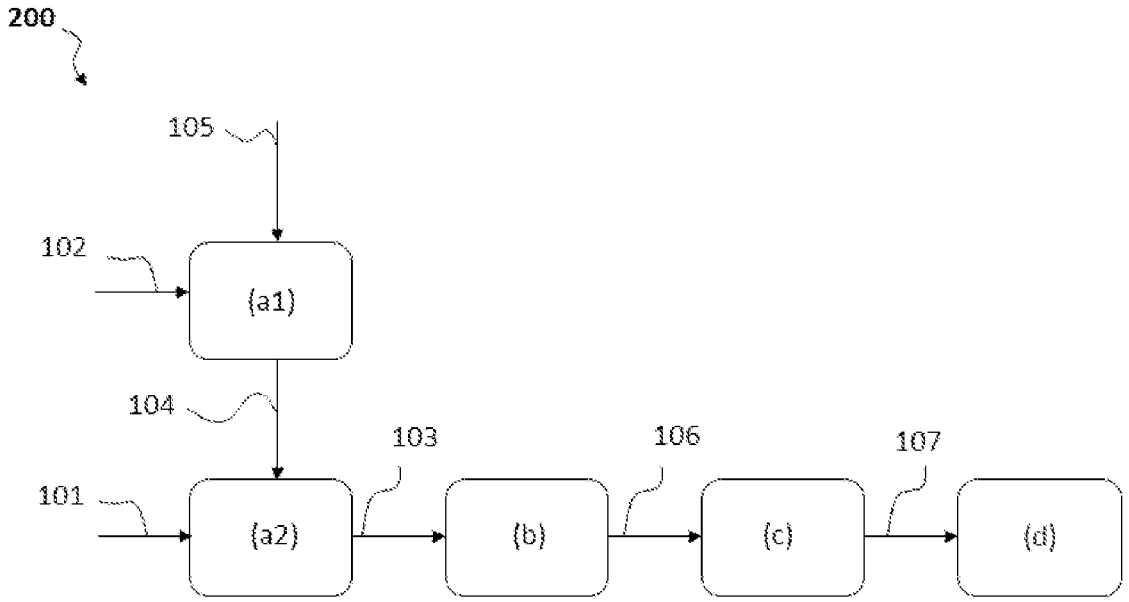
FIG. 2 is a block diagram illustrating a hybrid bed hydroconversion process according to one embodiment of the invention, wherein the catalyst precursor formulation is obtained by pre-mixing the organic additive with the catalyst precursor composition.

Second Embodiment: Pre-Mixing of the Catalyst Precursor Composition with the Organic Additive According to a second embodiment, as schematically illustrated at FIG. 2, mixing step (a) comprises (a1) pre-mixing the organic additive compound 102 with the catalyst precursor composition 105 to produce the catalyst precursor formulation 104, and (a2) mixing said catalyst precursor formulation 104 with said heavy oil feedstock 101.

Step (a1) of pre-mixing the organic additive compound 102 with the catalyst precursor composition 105 to produce the catalyst precursor formulation 104 can be carried out ex situ (i.e. outside the hydroconversion system).

In such a second embodiment, the conditioner mixer 610 comprises at least a first mixing apparatus for step (a1) and at least a second mixing apparatus for step (a2).

At step (a1), the organic additive is added such that the molar ratio of organic additive 102 to molybdenum (brought by the catalyst precursor composition, e.g. molybdenum 2-ethylhexanoate) in catalyst precursor formulation 104 is in a range of about 0.1:1 to about 20:1, preferably in a range of about 0.75:1 to about 7:1, and more preferably in a range of about 1:1 to about 5:1.

At step (a1) the catalyst precursor composition 105 is mixed below a temperature at which a substantial portion of the catalyst precursor composition begins to thermally decompose, preferably at a temperature comprised between room temperature, e.g. 15° and 300° C., preferably comprised between room temperature and 200° C., even more preferably comprised between 50° C. and 200° C., more preferably comprised between 75° C. to 150° C., and even most preferably comprised between 75° C. and 100° C.

Step (a1)

Step (a1) can be itself carried out in different manners detailed below.

Whereas it is within the scope of the invention to directly blend a catalyst precursor formulation consisting of the catalyst precursor composition 105 and the organic additive 102 with the heavy oil feedstock 101 at step (a2), the process according to said second embodiment of the invention preferably comprises at step (a1) the use of a hydrocarbon oil diluent to produce the catalyst precursor formulation 104, especially to aid in thoroughly and intimately blending the catalyst precursor composition within the feedstock at step (a2) in the relatively short period of time required for large-scale industrial operations to be economically viable.

Using a hydrocarbon oil diluent to produce the catalyst precursor formulation 104 shortens the mixing time at step (a2) for the reasons already given above in relation to the description of the diluted catalyst precursor composition for the first embodiment (reducing or eliminating differences in solubility, rheology etc.)

Examples of suitable hydrocarbon diluents include, but are not limited to, vacuum gas oil known as "VGO" (which typically has a boiling range of 360° C.-524° C.), decant oil or cycled oil (which typically has a boiling range of 360° C.-550° C., and light gas oil (which typically has a boiling range of 200° C.-360° C.).

The mass ratio of catalyst precursor composition 105 to hydrocarbon oil diluent in the catalyst precursor formulation 104 is preferably in a range of 1:500 to 1:1, more preferably in a range of 1:150 to 1:2, and most preferably in a range of 1:100 to 1:5 (e.g. 1:100, 1:50, 1:30, or 1:10).

Figure 3:
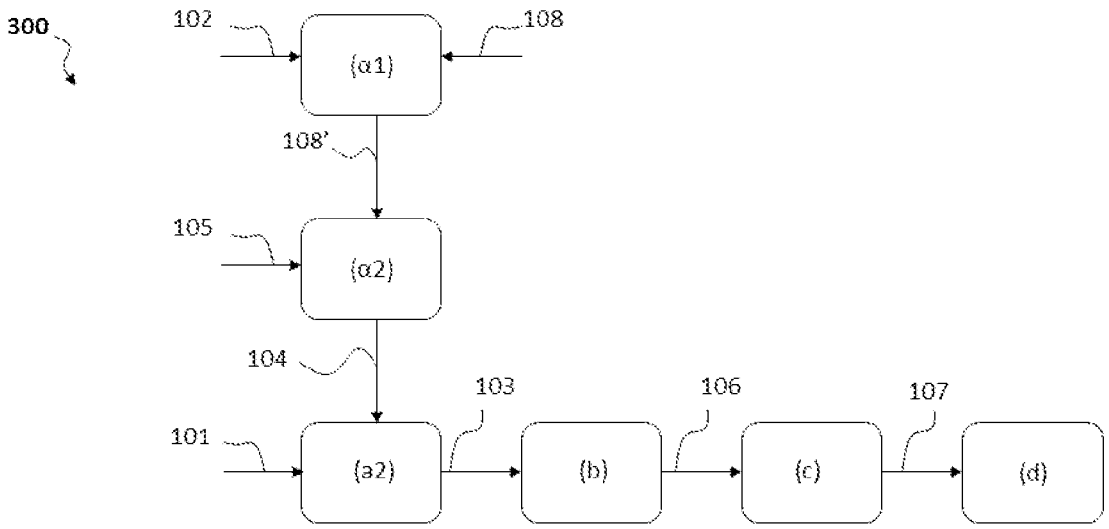
FIG. 3 is a block diagram illustrating an example of a hybrid bed hydroconversion as illustrated in FIG. 2, wherein the catalyst precursor formulation is obtained by mixing the catalyst precursor composition with an organic additive containing diluent.

According to one or more sub-embodiments, as schematically illustrated at FIG. 3, step (a1) of the process 300 according to said second embodiment comprises:

- (α1) pre-mixing said organic additive 102 with a hydrocarbon oil diluent 108 to form a diluent containing additive 108'; and
- (α2) mixing said diluent containing additive 108' with said catalyst precursor composition 105 to produce said catalyst precursor formulation 104.

Step (α1) is preferably carried out at a temperature comprised between room temperature, e.g. 15° C. and 300° C., preferably between room temperature and 200° C., even more preferably between 50° C. and 200° C., most preferably comprised between 75° C. and 150° C., and even most preferably comprised between 75° C. and 100° C.

The pressure for the pre-mixing stage (α1) is also advantageously the actual pressure of the diluent stream 108. Preferably, the gauge pressure for the pre-mixing stage (α1)

is comprised between 0 MPa and 25 MPa, more preferably comprised between 0.01 MPa and 5 MPa.

The residence time can be comprised between 1 second to several days, preferably in a range of 1 second to 30 minutes, more preferably in a range of 1 second to 10 minutes, and most preferably in a range of 1 second to 30 seconds.

Step (α2) is preferably carried out below a temperature at which a substantial portion of the catalyst precursor composition 105 begins to thermally decompose, preferably at a temperature comprised between room temperature, e.g. 15° C. and 300° C., preferably between room temperature and 200° C., even more preferably between 50° C. and 200° C., most preferably comprised between 75° C. and 150° C., and even most preferably comprised between 75° C. and 100° C.

The pressure for the mixing stage (α2) is also advantageously the actual pressure of the stream 108'. Preferably, the gauge pressure for the mixing stage (α2) is comprised between 0 MPa and 25 MPa, more preferably comprised between 0.01 MPa and 5 MPa.

The residence time can be comprised between 1 second to several days, preferably in a range of 1 second to 30 minutes, more preferably in a range of 1 second to 10 minutes, and most preferably in a range of 1 second to 30 seconds.

It will be appreciated that the actual temperature operated at step (α2) typically depends largely on the decomposition temperature of the particular precursor composition that is utilized.

Figure 4:
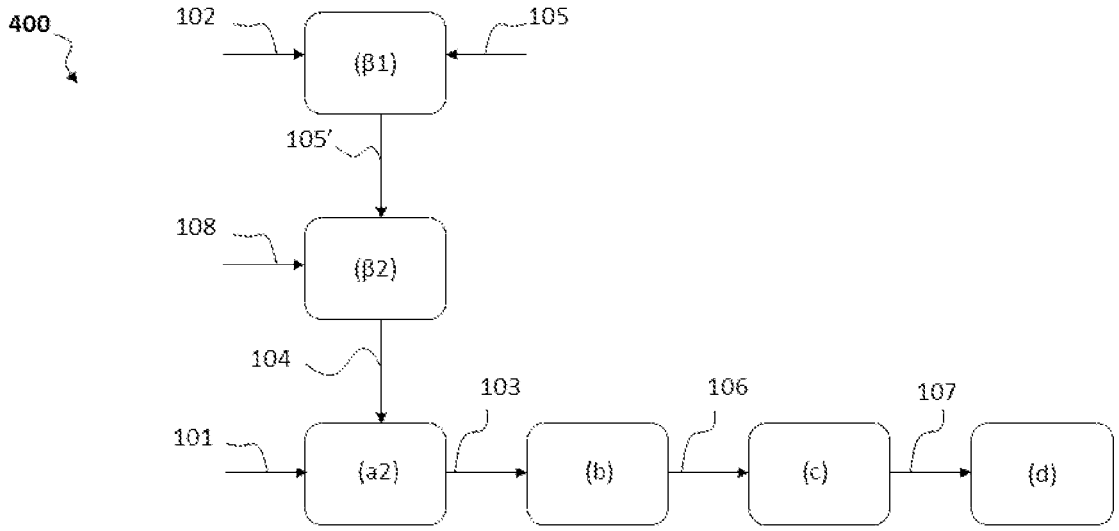
FIG. 4 is a block diagram illustrating another example of a hybrid bed hydroconversion as illustrated in FIG. 2, wherein the catalyst precursor formulation is obtained by mixing an additive containing catalyst precursor composition with a hydrocarbon oil diluent.

According to one or more sub-embodiments, as schematically illustrated at FIG. 4, step (a1) of the process 400 according to said second embodiment comprises:

(β1) pre-mixing said organic additive 102 with said catalyst precursor composition 105 to form a catalyst precursor composition containing additive 105'; and (β2) mixing said catalyst precursor composition containing additive 105' with a hydrocarbon oil diluent 108 to produce said catalyst precursor formulation 104.

Step (β1) is preferably carried out below a temperature at which a substantial portion of the catalyst precursor composition 105 begins to thermally decompose, preferably at a temperature comprised between room temperature, e.g. 15° C. and 300° C., preferably between room temperature and 200° C., even more preferably between 50° C. and 200° C., most preferably comprised between 75° C. and 150° C., and even most preferably comprised between 75° C. and 100° C.

Preferably, the gauge pressure for the mixing stage (β1) is comprised between 0 MPa and 25 MPa, more preferably comprised between 0.01 MPa and 5 MPa.

The residence time can be comprised between 1 second to several days, preferably in a range of 1 second to 30 minutes, more preferably in a range of 1 second to 10 minutes, and most preferably in a range of 1 second to 30 seconds.

Step (β2) is preferably carried out below a temperature at which a substantial portion of the catalyst precursor composition 105 begins to thermally decompose, preferably at a temperature comprised between room temperature, e.g. 15° C. and 300° C., preferably between room temperature and 200° C., even more preferably between 50° C. and 200° C., most preferably comprised between 75° C. and 150° C., and even most preferably comprised between 75° C. and 100° C.

Preferably, the gauge pressure for the mixing stage (β2) is comprised between 0 MPa and 25 MPa, more preferably comprised between 0.01 MPa and 5 MPa.

The residence time can be comprised between 1 second to several days, preferably in a range of 1 second to 30 minutes, more preferably in a range of 1 second to 10 minutes, and most preferably in a range of 1 second to 30 seconds.

It will be appreciated that the actual temperature used at steps (β1) and (β2) typically depends largely on the decomposition temperature of the particular precursor composition that is utilized.

Figure 5:
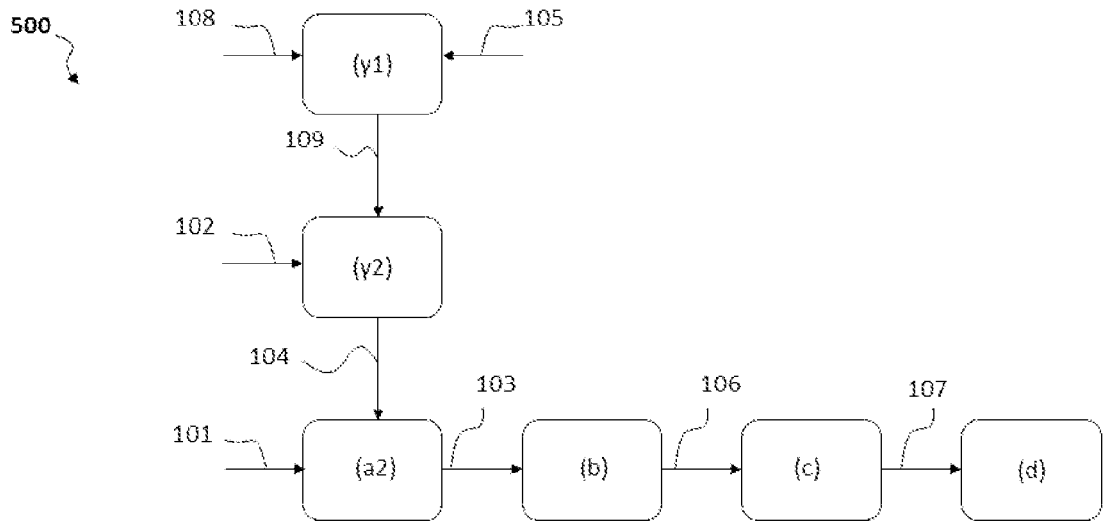
FIG. 5 is a block diagram illustrating another example of a hybrid bed hydroconversion as illustrated in FIG. 2, wherein the catalyst precursor formulation is obtained by mixing an diluted catalyst precursor composition with an organic additive.

According to one or more sub-embodiments, as schematically illustrated at FIG. 5, step (a1) of the process 500 according to said second embodiment comprises:

(γ1) pre-mixing said catalyst precursor composition 105 with a hydrocarbon oil diluent 108 to form a diluted catalyst precursor composition 109; and (γ2) mixing said diluted catalyst precursor composition 109 with the organic additive 102 to produce said catalyst precursor formulation 104.

Step (γ1) is preferably carried out below a temperature at which a substantial portion of the catalyst precursor composition 105 begins to thermally decompose, preferably at a temperature comprised between room temperature, e.g. 15° C. and 300° C., preferably between room temperature and 200° C., even more preferably between 50° C. and 200° C., most preferably comprised between 75° C. and 150° C., and even most preferably comprised between 75° C. and 100° C.

Preferably, the gauge pressure for the mixing stage (γ1) is comprised between 0 MPa and 25 MPa, more preferably comprised between 0.01 MPa and 5 MPa.

The residence time can be comprised between 1 second to several days, preferably in a range of 1 second to 30 minutes, more preferably in a range of 1 second to 10 minutes, and most preferably in a range of 1 second to 30 seconds.

Step (γ2) is preferably carried out below a temperature at which a substantial portion of the catalyst precursor composition 105 begins to thermally decompose, preferably at a temperature comprised between room temperature, e.g. 15° C. and 300° C., preferably between room temperature and 200° C., even more preferably between 50° C. and 200° C., most preferably comprised between 75° C. and 150° C., and even most preferably comprised between 75° C. and 100° C.

Preferably, the gauge pressure for the mixing stage (γ2) is comprised between 0 MPa and 25 MPa, more preferably comprised between 0.01 MPa and 5 MPa.

The residence time can be comprised between 1 second to several days, preferably in a range of 1 second to 30 minutes, more preferably in a range of 1 second to 10 minutes, and most preferably in a range of 1 second to 30 seconds.

It will be appreciated that the actual temperature used at steps (γ1) and (γ2) typically depends largely on the decomposition temperature of the particular precursor composition that is utilized.

The different mixing sub-steps of step (a1) can be carried out using different mixing apparatus, examples of which include, but are not limited to, high shear mixing such as mixing created in a vessel with a propeller or turbine impeller; multiple static in-line mixers; multiple static in-line mixers in combination with in-line high shear mixers; multiple static in-line mixers in combination with in-line high shear mixers; multiple static in-line mixers in combination with in-line high shear mixers followed by a pump around in the surge vessel; combinations of the above followed by one or more multi-stage centrifugal pumps; and one or more multi-stage centrifugal pumps. According to one embodiment, continuous rather than batch-wise mixing can be carried out using high energy pumps having multiple chambers within which the components to be mixed are churned and mixed as part of the pumping process itself.

For example, each of the different mixing sub-steps of step (a1) can be carried out in a dedicated vessel of an active mixing device being part of the first mixing apparatus of the conditioner mixer 610.

Such a configuration can in particular increase the dispersion of the colloidal or molecular catalyst formed in a later stage. The use of a dedicated vessel also allows to achieve a long residence time.

According to another example, each of the different mixing sub-steps of step (a1) can alternatively comprise injecting the component to be mixed into a pipe conveying the other component, herein called an in-pipe injection system. The second mixing apparatus of the conditioner mixer 610 thus comprises in such a configuration the portion(s) of the pipe wherein the mixing is performed, and possibly additional systems to help the mixing, for example static in-line mixers or high-shear in-line mixers as described above. Such a configuration can in particular reduce equipment investment and required footprint compared to mixing in a dedicated vessel.

According to another example, the first mixing apparatus of the conditioner mixer 610 can comprise a combination of such a dedicated vessel of an active mixing device and in-pipe injection systems possibly comprising static and/or high-shear in-line mixers.

Step (a2)

Step (a2) of mixing the catalyst precursor formulation 104 already containing the organic additive with said heavy oil feedstock 101 is preferably carried out below a temperature at which a substantial portion of the catalyst precursor composition begins to thermally decompose, such as at a temperature from room temperature, e.g. 15° C., to 300° C., preferably in a range of 50° C. to 200° C., and more preferably in a range of 75° C. to 175° C., to yield the conditioned heavy oil feedstock 103.

Preferably, the gauge pressure is comprised between 0 MPa and 25 MPa, more preferably comprised between 0.01 MPa and 5 MPa.

Step (a2) is performed for a time sufficient and in a manner so as to disperse the catalyst precursor formulation throughout the feedstock in order to yield a conditioned heavy oil feedstock 103 in which the catalyst precursor composition is thoroughly mixed within the heavy oil feedstock.

In order to obtain sufficient mixing of the catalyst precursor formulation 104 within the heavy oil feedstock before forming the colloidal or molecular catalyst, step (a2) is preferably carried out for a time period in the range of 1 second to 30 minutes, more preferably of 1 second to 10 minutes, and most preferably in a range of 2 seconds to 3 minutes.

Step (a2) according to the second embodiment can be carried out in a dedicated vessel of an active mixing device forming the second mixing apparatus of the conditioner mixer 610.

Such a configuration can in particular increase the dispersion of the colloidal or molecular catalyst formed in a later stage. The use of a dedicated vessel also allows to achieve a long residence time.

Step (a2) can alternatively comprise injecting said catalyst precursor formulation 104 into a pipe conveying the heavy oil feedstock 101 towards the hybrid ebullated-entrained bed reactor. The second mixing apparatus of the conditioner mixer 610 thus comprises in such a configuration the portion(s) of the pipe wherein the mixing is performed, and eventually additional systems to help the mixing, as for example static in-line mixers or high-shear in-line mixers as already described above. Such a configuration allows in particular to reduce equipment investment and required footprint compared to mixing in a dedicated vessel.

The second mixing apparatus of the conditioner mixer 610 can also comprise a combination of such a dedicated vessel of an active mixing device and in-pipe injection systems possibly comprising static and/or high-shear in-line mixers.

Alternatively, at step (a2), the catalyst precursor formulation 104 can be initially mixed with 20% of the heavy oil feedstock 101, the resulting mixed heavy oil feedstock can be mixed in with another 40% of the heavy oil feedstock, and the resulting 60% of the mixed heavy oil feedstock can be mixed in with the remaining 40% of heavy oil in accordance with good engineering practice of progressive dilution to thoroughly disperse the catalyst precursor formulation 104 in the heavy oil feedstock. Mixing time in the appropriate mixing devices or methods described herein should still be used in the progressive dilution approach.

The process according to the present invention is preferably carried out according to the second embodiment wherein step (a) comprises (a1) pre-mixing the organic additive compound 102 with the catalyst precursor composition 105 to produce the catalyst precursor formulation 104, and (a2) mixing said catalyst precursor formulation 104 with said heavy oil feedstock 101.

At step (a), the mixing of the heavy oil feedstock 101 with the catalyst precursor composition 104 can be done for the heavy oil feedstock 101, in part or in totality.

According to one or more preferred embodiments, the mixing step (a) is carried out between the catalyst precursor formulation 104 and the entire flow of the heavy oil feedstock 101 sent to the hydroconversion system. In one or more alternative embodiments, the mixing step (a) is carried out between the catalyst precursor formulation 104 and a part of the flow of the heavy oil feedstock 101 sent to the hydroconversion. Thus preparing the conditioned heavy oil feedstock 103 can be carried out by mixing at least a part of the flow of said heavy oil feedstock 101, for example at least 50 wt. % of the flow of said heavy oil feedstock 101, with the catalyst precursor formulation 104. The complementary part of the flow of said heavy oil feedstock 101 can be reincorporated once the catalyst precursor formulation 104 has been added, that is mixed with the conditioned heavy oil feedstock 103 before its preheating at step (b).

Step (b): Heating the Conditioned Heavy Oil Feedstock

The conditioned oil feedstock 103 formed at step (a) is then heated in at least one preheating device 630, before being introduced in the hybrid bed reactor for hydroconversion.

The conditioned oil feedstock 103 is sent to the at least one preheating device 630 optionally pressurized by a pump.

The preheating device comprises any heating means capable of heating a heavy oil feedstock known to a person skilled in the art. The preheating device can comprise a furnace comprising at least a preheating chamber, and/or tubes in which the oil feed flows, mixer of the conditioned oil feedstock with $H_2$, any type of suitable heat exchangers, for example tube or spiral heat exchangers in which the oil feed flows, etc.

This pre-heating of the conditioned heavy oil feedstock allows reaching a target temperature in the hybrid hydroconversion reactor at the later step (d).

The conditioned oil feedstock 103 is more preferably heated in the preheating device 630 to a temperature in a range of 280° C. to 450° C., even more preferably in a range of 300° C. to 400° C., and most preferably in a range of 320° C. to 365° C., in particular in order to later reach a target temperature in the hydroconversion reactor at step (c).

The skin temperature of the preheating device, e.g. skin temperature of the steel shell of a chamber or tubes of a furnace or heat exchanger(s), can reach 400° C. to 650° C. The mixing of the catalyst precursor formulation 104 comprising the catalyst precursor composition 105 and the organic additive 102 with the heavy oil feedstock 101 at step (a) avoids or reduces fouling that can occur in the preheating device at these high temperatures.

According to one or more embodiments, the conditioned feedstock is heated to a temperature that is 100° C. less than the hydroconversion temperature within the hybrid hydroconversion reactor, preferably 50° C. less than the hydroconversion temperature. For example, for a hydroconversion temperature in the range 410° C.-440° C., the conditioned oil feedstock can be heated at step (b) at a temperature in the range 310° C.-340° C.

The absolute pressure is comprised between atmospheric pressure (e.g. 0.101325 MPa) and 38 MPa, preferably between 5 MPa and 25 MPa and preferably between 6 MPa and 20 MPa.

Heating at this step (b) advantageously causes the conditioned oil feedstock to liberate sulfur that can combine with the metal of the catalyst precursor composition.

According to one or more embodiments, the colloidal or molecular catalyst is formed, or at least starts forming, in situ within the conditioned heavy oil feedstock at this step (b) of heating in the preheating device 630.

In order to form the colloidal or molecular catalyst, sulfur has to be available (e.g. as $H_2S$) to combine with the metal from the catalyst precursor composition.

Formation of the Colloidal or Molecular Catalyst In Situ within the Conditioned Heavy Oil Feedstock The general formation of the colloidal or molecular catalyst in situ within the conditioned heavy oil feedstock is described in detail below, as well as the conditions required for such a formation at step (b) and/or (c).

In the case where the heavy oil feedstock includes sufficient or excess sulfur, the final activated catalyst may be formed in situ by heating the conditioned heavy oil feedstock 103 to a temperature sufficient to liberate the sulfur therefrom.

A source of sulfur can thus be $H_2S$ dissolved in the heavy oil feedstock, or $H_2S$ contained in hydrogen recycled to the hybrid bed hydroconversion reactor for hydroconversion or $H_2S$ coming from organosulfur molecules present in the feedstock or eventually introduced beforehand in the heavy oil feedstock (injection of dimethyl disulfide, thioacetamide, any sulfur-containing hydrocarbon feedstock of the type of mercaptans, sulfides, sulfur-containing petroleum, sulfur-containing gas oil, sulfur-containing vacuum distillate, sulfur-containing residue), such an injection being rare and reserved for very atypical heavy oil feedstocks.

Thus a source of sulfur can be sulfur compounds within the feedstock or a sulfur compound added to the feedstock.

According to one or more embodiments, the formation of the dispersed colloidal or molecular catalyst is carried out with an absolute pressure of between atmospheric pressure and 38 MPa, preferably between 5 and 25 MPa and preferably between 6 and 20 MPa.

Due to the thorough mixing at step (a), a molecularly-dispersed catalyst may form upon reacting with sulfur to form the metal sulfide compound. Under some circumstances, minor agglomeration may occur, yielding colloidal-sized catalyst particles. However, it is believed that taking care to thoroughly mix the precursor composition throughout the heavy oil feedstock at step (a) will yield individual catalyst molecules rather than colloidal particles.

Simply blending, while failing to sufficiently mix, typically causes formation of large agglomerated metal sulfide compounds that are micron-sized or larger.

In order to form the metal sulfide catalyst, the conditioned feedstock 103 is preferably heated to a temperature in a range of room temperature, e.g. 15° C., to 500° C., more preferably in the range of 200° C. to 500° C., even more preferably in a range of 250° C. to 450° C., and even more preferably in a range of 300° C. to 435° C.

The temperature used at step (b) and/or (c) allows the formation of the metal sulfide catalyst.

The colloidal or molecular catalyst can thus be formed, at least in part, during this heating step (b), before the heated conditioned feedstock 106 is introduced into the hybrid bed hydroconversion reactor at step (c).

The colloidal or molecular catalyst can also be formed in situ within the hybrid bed hydroconversion reactor itself at step (c), especially either totally or in part in the case it has started to form at step (b).

The concentration of molybdenum in the conditioned oil feedstock is preferably in a range of 5 ppm to 500 ppm by weight of the heavy oil feedstock 101, more preferably in a range of 10 ppm to 300 ppm by weight, more preferably in a range of 10 ppm to 175 ppm by weight, even more preferably in a range of 10 ppm to 75 ppm by weight, and most preferably in a range of 10 ppm to 50 ppm by weight.

The Mo may become more concentrated as volatile fractions are removed from a non-volatile resid fraction.

Since the colloidal or molecular catalyst tends to be very hydrophilic, the individual particles or molecules will tend to migrate toward the more hydrophilic moieties or molecules within the heavy oil feedstock, especially asphaltenes. While the highly polar nature of the catalyst compound causes or allows the colloidal or the molecular catalyst to associate with asphaltene molecules, it is the general incompatibility between the highly polar catalyst compound and the hydrophobic heavy oil feedstock that necessitates the aforementioned intimate or thorough mixing of the oil soluble catalyst precursor formulation within the heavy oil feedstock prior to formation of the colloidal or molecular catalyst.

Preferably, the colloidal or molecular catalyst comprises molybdenum disulfide.

Theoretically, a nanometer-sized crystal of molybdenum disulfide has 7 molybdenum atoms sandwiched in between 14 sulfur atoms, and the total number of molybdenum atoms exposed at the edge, thus available for catalytic activity, are greater than in a micron-sized crystal of molybdenum disulfide. In practical terms, forming small catalyst particles as in the present invention, i.e. colloidal or molecular catalyst, with an enhanced dispersion results in more catalyst particles and more evenly distributed catalyst sites throughout the oil feedstock. Moreover, nanometer-sized or smaller molybdenum disulfide particles are believed to become intimately associated with asphaltene molecules.

Step (c): Hydroconversion of the Heated Conditioned Feedstock

The heated conditioned feedstock 106, is then introduced, optionally pressurized by a pump, especially if not already pressurized before step (b), into at least one hybrid ebullated-entrained bed reactor 640 together with hydrogen 601, and is operated at hydroconversion conditions to produce an upgraded material 107.

As previously mentioned, the colloidal or molecular catalyst can form in situ within the hybrid bed hydroconversion reactor itself at step (c), if not totally formed or not formed at all at step (b).

When the colloidal or molecular catalyst is formed in situ within the conditioned heavy oil feedstock at step (b), the heated conditioned feedstock 106 already contains the colloidal or molecular catalyst, in part or in totality, when entering the at least one hybrid ebullated-entrained bed reactor 640.

The hybrid ebullated-entrained bed reactor 640 comprises a solid phase that includes a porous supported catalyst under the form an expanded bed, a liquid hydrocarbon phase comprising said heated conditioned heavy oil feedstock 106 containing the colloidal or molecular catalyst dispersed therein, and a gaseous phase comprising hydrogen.

The hybrid ebullated-entrained bed reactor 640 is an ebullated bed hydroconversion reactor comprising the molecular or colloidal catalyst entrained out of the reactor with the effluents (upgraded feedstock), in addition to a porous supported catalyst, under the form of an expanded bed, maintained into the ebullated bed reactor.

According to one or more embodiments, the operation of the hybrid bed hydroconversion reactor is based on that of an ebullated bed reactor as used for the H-Oil™ process, such as described, for example, in U.S. Pat. No. 4,521,295 or U.S. Pat. No. 4,495,060 or U.S. Pat. No. 4,457,831 or U.S. Pat. No. 4,354,852 or in the paper Aiche, Mar. 19-23, 1995, Houston, Texas, paper number 46d, "Second generation ebullated bed technology". In this implementation, the ebullated bed reactor can comprise a recirculation pump which makes it possible to maintain the porous supported solid catalyst as a bubbling bed by continuous recycling of at least a part of a liquid fraction drawn off at the top of the reactor and reinjected at the bottom of the reactor.

The hybrid bed reactor preferably includes an input port located at or near the bottom of the hybrid bed reactor through which the heated conditioned feedstock 106 is introduced together with hydrogen 601, and an output port at or near the top of the reactor through which the upgraded material 107 is withdrawn. The hybrid bed reactor further includes an expanded catalyst zone comprising the porous supported catalyst. The hybrid bed reactor also comprises a lower supported catalyst free zone located below the expanded catalyst zone, and an upper supported catalyst free zone above the expanded catalyst zone. The colloidal or molecular catalyst is dispersed throughout the feedstock within the hybrid bed reactor, including both the expanded catalyst zone and the supported catalyst free zones thereby being available to promote upgrading reactions within what constitute catalyst free zones in conventional ebullated bed reactors. Feedstock within the hybrid bed reactor is continuously recirculated from the upper supported catalyst free zone to the lower supported catalyst free zone by means of a recycling channel in communication with an ebullating pump. At the top of the recycling channel is a funnel-shaped recycle cup through which feedstock is drawn from the upper supported catalyst free zone. The internal recycled feedstock is blended with fresh heated conditioned feedstock 106 and supplemental hydrogen gas 601.

As is known, and described for example in patent FR3033797, when it is spent, the porous supported hydroconversion catalyst may be partly replaced with fresh catalyst, by withdrawing the spent catalyst preferably at the bottom of the reactor, and by introducing fresh catalyst either at the top or at the bottom of the reactor. This replacement of spent catalyst is preferably performed at regular time intervals, and preferably portionwise or virtually continuously. These withdrawals/replacements are performed using devices which advantageously make possible the continuous functioning of this hydroconversion step. For example, input and output tubes opening into the expanded catalyst zone can be used for introducing/withdrawing respectively the fresh and spent supported catalyst.

The presence of colloidal or molecule catalyst within the hybrid bed reactor provides additional catalytic hydrogenation activity, both within the expanded catalyst zone, the recycle channel, and the lower and upper supported catalyst free zones. Capping of free radicals outside of the porous supported catalyst minimizes formation of sediments and coke precursors, which are often responsible for deactivating the supported catalyst. This can allow a reduction in the amount of porous supported catalyst that would otherwise be required to carry out a desired hydroprocessing reaction. It can also reduce the rate at which the porous supported catalyst must be withdraw and replenished.

The hydroconversion porous supported catalyst used in hydroconversion step (c) may contain one or more elements from Groups 4 to 12 of the Periodic Table of the Elements, which are deposited on a support. The support of the porous supported catalyst can advantageously be an amorphous support, such as silica, alumina, silica/alumina, titanium dioxide or combinations of these structures, and very preferably alumina.

The catalyst may contain at least one metal from Group VIII chosen from nickel and cobalt, preferably nickel, said element from Group VIII preferably being used in combination with at least one metal from Group VIB chosen from molybdenum and tungsten; preferably, the metal from Group VIB is molybdenum.

In the present description, the groups of chemical elements can be given according to the CAS classification (CRC Handbook of Chemistry and Physics, published by CRC Press, Editor in Chief D. R. Lide, 81st edition, 2000-2001). For example, Group VIII according to the CAS classification corresponds to the metals of columns 8, 9 and 10 according to the new IUPAC classification.

Advantageously, the hydroconversion porous supported catalyst used in the hydroconversion step (d) comprises an alumina support and at least one metal from Group VIII chosen from nickel and cobalt, preferably nickel, and at least one metal from Group VIB chosen from molybdenum and tungsten, preferably molybdenum. Preferably, the hydroconversion porous supported catalyst comprises nickel as element from Group VIII and molybdenum as element from Group VIB.

The content of metal from the non-noble group VIII, in particular of nickel, is advantageously between 0.5% and 10% by weight, expressed as weight of metal oxide (in particular NiO), and preferably between 1% and 6% by weight, and the content of metal from group VIB, in particular of molybdenum, is advantageously between 1% and 30% by weight, expressed as weight of metal oxide (in particular of molybdenum trioxide $MoO_3$), and preferably between 4% and 20% by weight. The contents of metals are expressed as weight percentage of metal oxide relative to the weight of the porous supported catalyst.

This porous supported catalyst is advantageously used in the form of extrudates or of beads. The beads have, for example, a diameter of between 0.4 mm and 4.0 mm. The extrudates have, for example, a cylindrical form with a diameter of between 0.5 mm and 4.0 mm and a length of between 1 mm and 5 mm. The extrudates may also be objects of a different shape such as trilobes, regular or irregular tetralobes, or other multilobes. Porous supported catalysts of other forms may also be used.

The size of these various forms of porous supported catalysts may be characterized by means of the equivalent diameter. The equivalent diameter is defined as six times the ratio between the volume of the particle and the external surface area of the particle. The porous supported catalyst used in the form of extrudates, beads or other forms thus has an equivalent diameter of between 0.4 mm and 4.4 mm. These porous supported catalysts are well known to those skilled in the art.

In the hydroconversion step (c), said heated conditioned feedstock 106 is generally converted under conventional conditions for hydroconversion of a heavy oil feedstock. According to one or more embodiments, the hydroconversion step (c) is carried out under an absolute pressure of between 2 and 38 MPa, preferably between 5 and 25 MPa and preferably between 6 and 20 MPa, and at a temperature between 300° C. and 550° C., preferably between 350° C. and 500° C., preferably between 370° C. and 450° C., more preferably between 400° C. and 440° C., and even more preferably between 410° C. and 435° C. According to one or more embodiments, the liquid hourly space velocity (LHSV) of the feedstock relative to the volume of each hybrid reactor is between 0.05 $h^{-1}$ and 10 $h^{-1}$, preferably between 0.10 $h^{-1}$ and 2 $h^{-1}$ and preferably between 0.10 $h^{-1}$ and 1 $h^{-1}$. According to another embodiment, the LHSV is between 0.05 $h^{-1}$ and 0.09 $h^{-1}$h. LHSV is defined as the liquid feed volumetric flow rate at room temperature and atmospheric pressure (typically 15° C. and 0.101325 MPa) per reactor volume.

According to one or more embodiments, the amount of hydrogen mixed with the heavy oil feedstock 106 is preferably between 50 and 5000 normal cubic meters ($Nm^3$) per cubic meter ($m^3$) of liquid heavy oil feedstock, such as between 100 and 3000 $Nm^3/m^3$ and preferably between 200 and 2000 $Nm^3/m^3$.

According to one or more embodiments, the hydroconversion step (c) is carried out in one or more hybrid bed hydroconversion reactors, which can be in series and/or in parallel.

Step (d): Further Processing of the Upgraded Material from Hydroconversion Step (c)

The upgraded material 107 can be further processed.

Examples of such further processing comprise, without limitation, at least one from among: a separation of hydrocarbon fractions of the upgraded material, a further hydroconversion in one or more supplemental hybrid ebullated-entrained bed reactors or ebullated bed reactors to produce a further upgraded material, a fractionation of hydrocarbon cuts of the further upgraded material, a deasphalting of at least a part of the upgraded material 107 or a heavy liquid fraction resulting from a fractionation of the upgraded material or further upgraded material, a purification in a guard bed of the upgraded or further upgraded material to remove at least a portion of the colloidal or molecular catalyst and metal impurities.

The various hydrocarbon fractions that can be produced from the upgraded material 107 can be sent to different processes in the refinery, and details on these post-processing operations are not described herein as they are generally known to the skilled person and will complicate the description to no purpose. For example, gas fractions, naphtha, middle distillates, VGO, DAO can be sent to processes of hydrotreating, steam cracking, fluid catalytic cracking (FCC), hydrocracking, lubricating oil extraction, etc., residues (atmospheric or vacuum residues) can also be post-processed, or used for other applications like gasification, bitumen production etc. Heavy fractions, including residues, can also be recycled in the hydroconversion process, for example in the hybrid bed reactor.

Figure 6:
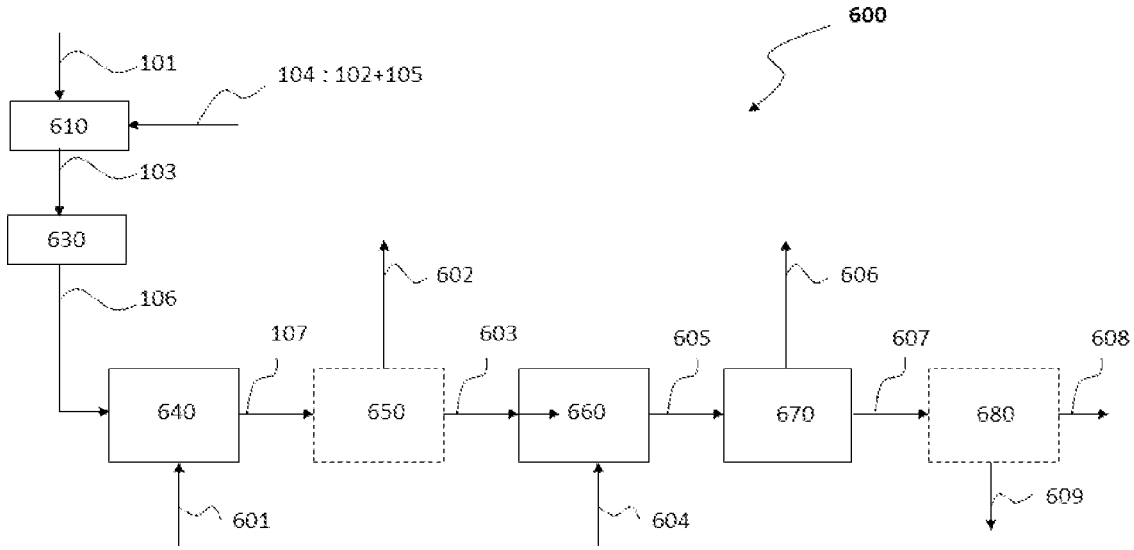
FIG. 6 is a block diagram illustrating an example of a hybrid bed hydroconversion process and system according to the invention.

According to one or more embodiments, as illustrated in FIG. 6, the process further comprises:

- a second hydroconversion step in a second hybrid ebullated-entrained bed reactor 660 in the presence of hydrogen 604 of at least a portion or all of the upgraded material resulting from the hydroconversion step (c) or optionally of a liquid heavy fraction 603 that boils predominantly at a temperature greater than or equal to 350° C. resulting from an optional separation step separating a portion or all of the upgraded material resulting from the hydroconversion step (c), said second hybrid ebullated-entrained bed reactor 660 comprising a second porous supported catalyst and operating at hydroconversion conditions to produce a hydroconverted liquid effluent 605 with a reduced heavy residue fraction, a reduced Conradson carbon residue, and possibly a reduced quantity of sulfur, and/or nitrogen, and/or metals;
- a step of fractionating a portion or all of said hydroconverted liquid effluent 605 in a fractionation section 670 to produce at least one heavy cut 607 that boils predominantly at a temperature greater than or equal to 350° C., said heavy cut containing a residual fraction that boils at a temperature greater than or equal to 540° C.;
- an optional step of deasphalting a portion or all of said heavy cut 607 in a deasphalter 680 with at least one hydrocarbon solvent to produce a deasphalted oil DAO 608 and a residual asphalt 609.

Said second hydroconversion step is performed in a manner similar to that which was described for the hydroconversion step (c), and its description is not therefore repeated here.

This applies notably for the operating conditions, the equipment used, the hydroconversion porous supported catalysts used, with the exception of the specifications given below.

As for the hydroconversion step (c), the second hydroconversion step is performed in a second hybrid ebullated-entrained bed reactor 660 similar to hybrid bed reactor 640.

In this additional hydroconversion step, the operating conditions may be similar or different from those in the hydroconversion step (c), the temperature remaining within the range between 300° C. and 550° C., preferably between 350° C. and 500° C., more preferably between 370° C. and 450° C., more preferably between 400° C. and 440° C., and even more preferably between 410° C. and 435° C., and the amount of hydrogen introduced into the reactor remaining within the range between 50 and 5000 $Nm^3/m^3$ of liquid feedstock, preferably between 100 and 3000 $Nm^3/m^3$, and even more preferably between 200 and 2000 $Nm^3/m^3$.

The other pressure and LHSV parameters are within ranges identical to those described for the hydroconversion step (c).

The hydroconversion porous supported catalyst used in the second hybrid bed reactor 660 may be the same as that used in hybrid bed reactor 640, or may also be another porous supported catalyst also suitable for hydroconversion of heavy oil feedstocks, as defined for the supported catalyst used in hydroconversion step (c).

The optional separation step, separating a portion or all of the upgraded material 107 to produce at least two fractions including the heavy liquid fraction 603 that boils predominantly at a temperature greater than or equal to 350° C., is carried out in a separation section 650.

The other cut(s) 602 are light and intermediate cut(s). The light fraction thus separated contains mainly gases ($H_2$, $H_2S$, $NH_3$, and $C_1$-$C_4$), naphtha (fraction that boils at a temperature below 150° C.), kerosene (fraction that boils between 150° C. and 250° C.), and at least one portion of the diesel (fraction that boils between 250° C. and 375° C.). The light fraction may then be sent at least partly to a fractionating unit (not represented in FIG. 6) where the light gases are extracted from said light fraction, for example by passing through a flash drum. The gaseous hydrogen thus recovered, which can have been sent to a purification and compression equipment, may advantageously be recycled into the hydroconversion step (c). The recovered gaseous hydrogen can also be used in other equipment of the refinery.

The separation section 650 comprises any separation means known to a person skilled in the art. It can comprise one or more flash drums arranged in series, and/or one or more steam- and/or hydrogen-stripping columns, and/or an atmospheric distillation column, and/or a vacuum distillation column, and is preferably constituted by a single flash drum, commonly known as a "hot separator".

The step of fractionating, separating a portion or all of the hydroconverted liquid effluent from the second hydroconversion step to produce at least two fractions including the at least one heavy liquid cut 607 that boils predominantly at a temperature above 350° C., preferably above 500° C. and preferably above 540° C., is carried out in the fractionation section 670 comprising any separation means known to a person skilled in the art. The other cut(s) 606 are light and intermediate cut(s).

The heavy liquid cut 607 contains a fraction that boils at a temperature above 540° C., referred to as vacuum residue (which is the unconverted fraction). It may contain a portion of the diesel fraction that boils between 250° C. and 375° C. and a fraction that boils between 375° C. and 540° C. referred to as vacuum distillate.

The fractionation section 670 can comprise one or more flash drums arranged in series, and/or one or more steam and/or hydrogen-stripping columns, and/or an atmospheric distillation column, and/or a vacuum distillation column, and is preferably constituted by a set of several flash drums in series and atmospheric and vacuum distillation columns.

Where it is desired to recycle a part of the heavy resid fraction (e.g. part of the heavy liquid cut 607, and/or part of the residual asphalt 609, or part of DAO 608) back through the hydroconversion system (e.g. for example in hybrid bed reactor 640 or upstream) it may be advantageous to leave the colloidal or molecular catalyst within the resid, and/or residual asphalt fraction. A purging on the recycled stream can be carried out, in general for preventing some compounds from accumulating at excessive levels.

The present invention also relates to an ebullated-entrained bed system 600 configured for hydroconverting the heavy oil feedstock 101 as detailed above. Numerical references mentioned below relate to FIG. 6, which illustrates schematically an example of a hybrid bed hydroconversion system according to the invention. Said system 600 comprises:

- the conditioner mixer 610 configured to prepare the conditioned heavy oil feedstock 103 by mixing said heavy oil feedstock 101 with the catalyst precursor formulation 104 which comprises the catalyst precursor composition 105 comprising molybdenum and the organic additive at a molar ratio between said organic chemical compound 102 and molybdenum being comprised between 0.1:1 and 20:1;
- the at least one preheating device 630 configured to heat the conditioned feedstock 103;
- the at least one hybrid ebullated-entrained bed reactor 640 configured to comprise:
  - an expanded catalyst bed comprising a solid phase that includes a porous supported catalyst as a solid phase,
  - a liquid hydrocarbon phase comprising the heated conditioned heavy oil feedstock 106 containing the colloidal or molecular catalyst dispersed therein;
  - and a gaseous phase comprising hydrogen.

Said at least one hybrid ebullated-entrained bed reactor 640 is also configured to operate in the presence of hydrogen and at hydroconversion conditions in order to cause thermal cracking of hydrocarbons in said heated conditioned feedstock to provide an upgraded material 107.

Said at least one preheating device 630 and/or said at least one hybrid ebullated-entrained bed reactor 640 are also configured to form the colloidal or molecular catalyst within said conditioned heavy oil feedstock.

Details on each apparatus/device/section used in the ebullated-entrained bed system have already been given above in relation to the process and are not repeated.

EXAMPLE

The following example illustrates, without limiting the scope of the invention, some of the performance qualities of the process and system according to the invention, in particular the reduced fouling of equipment, in comparison with a process and system according to the prior art.

The example is based on a test using an analytical device, called Alcor Hot Liquid Process Simulator, or HLPS, simulating the fouling effect of atmospheric residues (AR) in heat exchangers. The AR is pumped through a heater tube (laminar flow tube-in-shell heat exchanger) under controlled conditions and fouling deposits are formed on the heater tube. The temperature of the AR which exits the heat exchanger is related to the effect of the deposits on the efficiency of the heat exchanger. The decrease in AR liquid outlet temperature from its initial maximum value is called Delta T and is correlated to the deposit quantity. The higher the decreasing of Delta T, the higher the fouling and the deposit quantity.

The HLPS test can be used to evaluate the fouling tendency of different AR by comparing the decreasing slope of the AR liquid outlet temperature obtained under identical test conditions. The effectiveness of an organic additive can also be determined by comparing test results from a neat sample (without an organic additive) to the sample blended with the organic additive.

Two samples are tested: sample 1 is a blend of a heavy oil feedstock and a molecular or colloidal catalyst according to the prior art, and sample 2 is a blend according to the invention comprising the same heavy oil feedstock with the same molecular or colloidal catalyst, in addition to an organic additive.

The heavy oil feedstock used ("Feed") is an atmospheric residue (AR) whose main composition and properties are given table 1 below.

TABLE 1

| | Standardized method | Unit | Feed | VGO (CPC diluent) |
|---|---|---|---|---|
| Density | NF EN ISO 12185 | | 0.959 | 0.8677 |
| IBP-350° C. | ASTM D1160 | wt % | 21 | 2.7 |
| 350-540° C. | ASTM D1160 | wt % | 35 | 95.5 |
| 540° C.+ | ASTM D1160 | wt % | 44 | 1.8 |
| C | ASTM D5291 | wt % | 84.5 | 86.5 |
| H | ASTM D5291 | wt % | 11.4 | 13.71 |
| N | ASTM D5291 | wt % | 0.3 | 0.0037 |
| S | NF ISO 8754 | wt % | 3.81 | 0.074 |
| Ni | ASTM D7260 | wt ppm | 25 | <2 |
| V | ASTM D7260 | wt ppm | 78 | <2 |
| K | ASTM D7260 | wt ppm | 2 | <1 |
| Na | ASTM D7260 | wt ppm | 196 | <1 |
| Ca | ASTM D7260 | wt ppm | <1 | <1 |
| P | ASTM D7260 | wt ppm | <5 | <5 |
| Si | ASTM D7260 | wt ppm | <1 | <1 |
| Fe | ASTM D7260 | wt ppm | 3 | 6 |
| Ti | ASTM D7260 | wt ppm | 79 | <1 |
| Asphaltenes $C_5$ | UOP99 - 07 | wt % | 10.6 | 0.2 |
| Asphaltenes $C_7$ | NF T60-115 | wt % | 4.7 | 0.05 |
| Conradson Carbon | NF EN ISO 10370 | wt % | 11.3 | 0.2 |

Sample 1: sample 1 is a blend of the Feed (AR) and a catalyst precursor composition (CPC) being molybdenum 2-ethylhexanoate diluted in a vacuum gas oil (VGO).

The composition of the VGO is given in table 1 above.

The CPC solution is obtained by mixing the molybdenum 2-ethylhexanoate with the VGO, at a temperature of 70° C. and for a time period of 30 minutes. The molybdenum content in the solution of CPC containing VGO is 3500 wt. ppm.

The solution of CPC is then mixed with the Feed (AR) at a temperature of 70° C. and for a time period of 30 minutes.

The content of Mo in sample 1 is of 283 wt. ppm (see table 2 below).

Sample 2: sample 2 is a blend of Feed (AR) with the same CPC solution (molybdenum 2-ethylhexanoate diluted with the VGO) as in sample 1, and with an organic additive being 2-Ethylhexanoic Acid (2EHA). The CAS number of 2EHA is 149-57-5.

The solution of CPC, obtained as detailed for sample 1, is first mixed with 2EHA, for a time period of 30 min, and at temperature of 70° C.

Then, the solution of CPC containing the organic additive 2EHA is mixed with the Feed (AR), at a temperature of 70° C. and for a time period of 30 minutes.

The content of Mo in sample 2 is of 283 wt. ppm (see table 2 below).

The concentration of organic additive 2EHA is 5761 wt. ppm (see table 2 below).

The molar ratio of 2EHA/Mo=13.6.

TABLE 2

| | Sample 1: Feed + CPC in VGO | Sample 2: Feed + (CPC in VGO + 2EHA) |
|---|---|---|
| Mo (wt ppm) | 283 | 283 |
| Acid organic additive 2EHA (wt ppm) | — | 5761 |

The Mo content in the samples was determined according to ASTM D7260. Acid and ester organic additive content was determined by weighing.

The HLPS test conditions are given in table 3 below.

TABLE 3

| Test mode | Single pass |
|---|---|
| Feed temperature (° C.) | 90 |
| Flow rate (mL/min) | 1 |
| Oil in temperature (° C.) | 100 |
| Tube temperature (° C.) | 450 |
| Tube material | 1018 steel |
| Gauge Pressure (MPa) | 3.4 |

Figure 7:
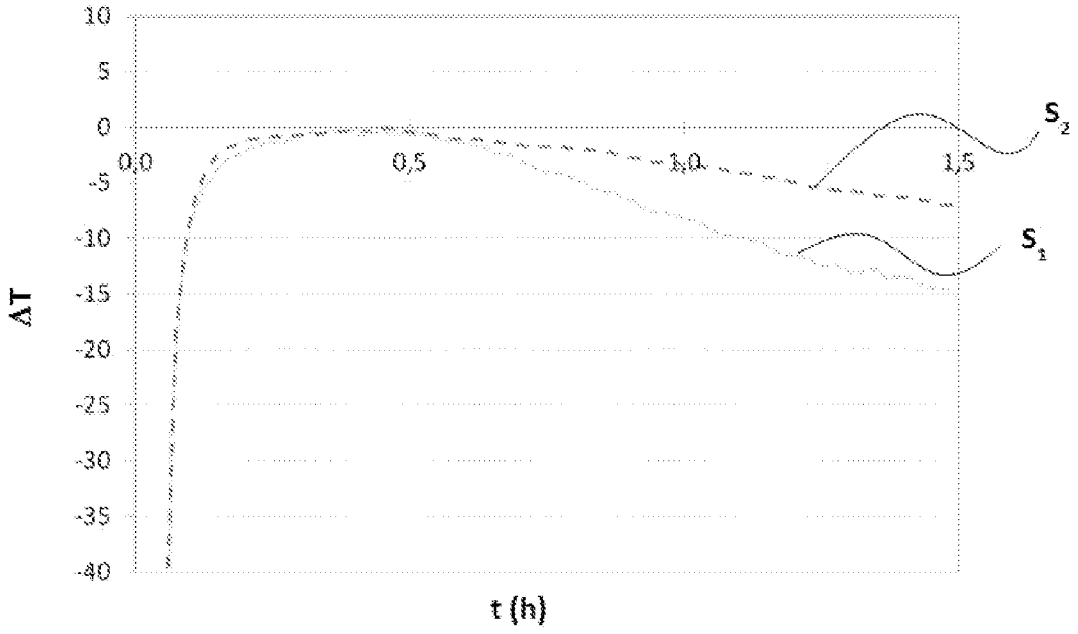
FIG. 7 is a graph showing the fouling tendency of examples of conditioned oil feedstocks as prepared in the hybrid bed hydroconversion process according to the invention and according to prior art.

The results of the test for the different samples ($S_1$ for sample 1, $S_2$ for sample 2) are shown in the graph of FIG. 7. X-axis represents time in hours, and Y-axis represents the difference in temperature ΔT between the temperature of the oil blend (sample) exiting the tube at a time t $[T_{Oil\ Out}]_t$ and the maximum temperature of the oil blend (sample) exiting the tube $[T_{Oil\ Out}]_{Max}$: $\Delta T=[T_{Oil\ Out}]_t-[T_{Oil\ Out}]_{Max}$.

The results show that the sample 1 has a strong fouling tendency since its Delta T falls quickly. Sample 2 which contains an organic additive, e.g. 2EHA, according to the invention has a lower Delta T than sample 1, showing that the fouling behavior is significantly reduced under the action of said organic additive.

The invention claimed is:

1. A process for hydroconversion of a heavy oil feedstock (101) containing a fraction of at least 50% by weight having a boiling point of at least 300° C., and containing metals and asphaltenes, wherein the heavy oil feedstock (101) comprises at least one of the following feedstocks: heavy crude oil, oil sand bitumen, atmospheric tower bottoms, vacuum tower bottoms, resid, visbreaker bottoms, coal tar, heavy oil from oil shale, liquefied coal, heavy bio oils, and heavy oils comprising plastic waste and/or a plastic pyrolysis oil, said process comprising:

(a) preparing a conditioned heavy oil feedstock (103) by mixing said heavy oil feedstock (101) with a catalyst precursor formulation (104) in a manner so that a colloidal or molecular catalyst is formed when the catalyst precursor formulation (104) reacts with sulfur, said catalyst precursor formulation (104) comprising:

a catalyst precursor composition (105) comprising an oil soluble organo-metallic compound or complex comprising molybdenum, and an organic chemical compound (102) is selected from the group consisting of ethylhexanoic acid, naphthenic acid, caprylic acid, adipic acid, pimelic acid, suberic acid, azelaic acid, sebacic acid, ethyl octanoate, ethyl 2-ethylhexanoate, 2-ethylhexyl 2-ethylhexanoate, benzyl 2-ethylhexanoate, diethyl adipate, dimethyl adipate, bis(2-ethylhexyl) adipate, dimethyl pimelate, dimethyl suberate, monomethyl suberate, hexanoic anhydride, caprylic anhydride, and mixtures thereof, and the molar ratio between said organic chemical compound (102) and molybdenum in said catalyst precursor formulation (104) being between 0.1:1 and 20:1;

(b) heating said conditioned heavy oil feedstock (103) from (a) in at least one preheating device;

(c) introducing said heated conditioned heavy oil feedstock (106) from (b) into at least one hybrid ebullated-entrained bed reactor comprising a hydroconversion porous supported catalyst and operating said hybrid ebullated-entrained bed reactor in the presence of hydrogen and at hydroconversion conditions to produce an upgraded material (107) and wherein the colloidal or molecular catalyst is formed in situ within the conditioned heavy oil feedstock at (b) and/or at (c).

2. The process as claimed in claim 1, wherein (a) comprises simultaneously mixing said organic chemical compound (102) with said catalyst precursor composition (105) and with said heavy oil feedstock (101).

3. The process as claimed in claim 1, wherein (a) comprises (a1) pre-mixing said organic chemical compound (102) with said catalyst precursor composition (105) to produce said catalyst precursor formulation (104) and (a2) mixing said catalyst precursor formulation (104) with said heavy oil feedstock (101).

4. The process as claimed in claim 3, wherein at (a1) said catalyst precursor composition (105) is mixed at a temperature between room temperature and 300° C.

5. The process as claimed in claim 1, wherein a hydrocarbon oil diluent is used to form the catalyst precursor formulation (104).

6. The process as claimed in claim 1, wherein the organic chemical compound (102) comprises 2-ethylhexanoic acid.

7. The process as claimed in claim 1, wherein the organic chemical compound (102) comprises ethyl octanoate or 2-ethylhexyl 2-ethylhexanoate.

8. The process as claimed in claim 1, wherein the molar ratio between said organic chemical compound (102) and molybdenum of said catalyst precursor formulation (104) is between 0.75:1 and 7:1.

9. The process as claimed in claim 1, wherein the colloidal or molecular catalyst comprises molybdenum disulfide.

10. The process as claimed in claim 1, wherein (b) comprises heating at a temperature between 280° C. and 450° C.

11. The process as claimed in claim 1, wherein the heavy oil feedstock (101) has a sulfur at a content of greater than 0.5% by weight, a Conradson carbon residue of at least 0.5% by weight, $C_7$ asphaltenes at a content of greater than 1% by weight, transition and/or post-transition and/or metalloid metals at a content of greater than 2 ppm by weight, and alkali and/or alkaline earth metals at a content of greater than 2 ppm by weight.

12. The process as claimed in claim 1, wherein said hydroconversion (c) is carried out under an absolute pressure of between 2 MPa and 38 MPa, at a temperature of between 300° C. and 550° C., at an liquid hourly space velocity LHSV relative to the volume of each hybrid reactor of between 0.05 $h^{-1}$ and 10 $h^{-1}$ and under an amount of hydrogen mixed with the feedstock entering hybrid bed reactor of between 50 and 5000 normal cubic meters ($Nm^3$) per cubic meter ($m^3$) of feedstock.

13. The process as claimed in claim 1, wherein the concentration of molybdenum in the conditioned oil feedstock is in a range of 5 ppm to 500 ppm by weight of the heavy oil feedstock.

14. The process as claimed in claim 1, wherein the hydroconversion porous supported catalyst contains at least one metal from the non-noble group VIII chosen from nickel and cobalt, and at least one metal from group VIB chosen from molybdenum and tungsten, and includes an amorphous support.

15. The process as claimed in claim 1, further comprising:

a second hydroconversion in a second hybrid ebullated-entrained bed reactor of at least a portion or all of the upgraded material resulting from the hydroconversion (c) or optionally of a liquid heavy fraction that boils predominantly at a temperature greater than or equal to 350° C. resulting from an optional separation separating a portion or all of the upgraded material resulting from the hydroconversion (c), said second hybrid ebullated-entrained bed reactor comprising a second porous supported catalyst and operating in the presence of hydrogen and at hydroconversion conditions to produce a hydroconverted liquid effluent with a reduced heavy residue fraction and a reduced Conradson carbon residue, fractionating a portion or all of said hydroconverted liquid effluent in a fractionation section (F) to produce at least one heavy cut that boils predominantly at a temperature greater than or equal to 350° C., said heavy cut containing a residual fraction that boils at a temperature greater than or equal to 540° C.;

optionally deasphalting a portion or all of said heavy cut resulting with at least one hydrocarbon solvent to produce a deasphalted oil DAO and a residual asphalt; and wherein, said hydroconversion (c) and said second hydroconversion are carried out under an absolute pressure of between 2 and 38 MPa, at a temperature of between 300° C. and 550° C., at an hourly space velocity HSV relative to the volume of each hybrid ebullated-entrained bed reactor of between 0.05 $h^{-1}$ and 10 $h^{-1}$ and under an amount of hydrogen mixed with the feedstock entering each hybrid ebullated-entrained bed reactor of between 50 and 5000 normal cubic meters ($Nm^3$) per cubic meter ($m^3$) of feedstock.

16. The process as claimed in claim 1, wherein the molar ratio between said organic chemical compound (102) and molybdenum of said catalyst precursor formulation (104) is comprised between 1:1 and 5:1.

17. The process as claimed in claim 1, wherein (b) comprises heating at a temperature between 300° C. to 400° C.

18. The process as claimed in claim 1, wherein (a) comprises simultaneously mixing said organic chemical compound (102) with said catalyst precursor composition (105), previously diluted with a hydrocarbon oil diluent, and with said heavy oil feedstock (101).

19. The process as claimed in claim 1, wherein (a) comprises simultaneously mixing said organic chemical compound (102) with said catalyst precursor composition (105) and with said heavy oil feedstock (101) at a temperature between room temperature and 300° C. and for a time period of 1 second to 30 minutes.

20. The process as claimed in claim 1, wherein the organic chemical compound (102) is selected from ethyl octanoate, ethyl 2-ethylhexanoate, 2-ethylhexyl 2-ethylhexanoate, benzyl 2-ethylhexanoate, diethyl adipate, dimethyl adipate, bis (2-ethylhexyl) adipate, dimethyl pimelate, dimethyl suberate, monomethyl suberate, hexanoic anhydride, caprylic anhydride, and mixtures thereof.

21. The process as claimed in claim 1, wherein the organic chemical compound (102) is selected from adipic acid, pimelic acid, suberic acid, azelaic acid, and mixtures thereof.

* * * * *